US011096266B2

(12) United States Patent
Riggs et al.

(10) Patent No.: US 11,096,266 B2
(45) **Date of Patent: *Aug. 17, 2021**

(54) TARGET EXPANSION RATE CONTROL IN AN EXTREME ULTRAVIOLET LIGHT SOURCE

(71) Applicant: ASML Netherlands B.V., Veldhoven (NL)

(72) Inventors: Daniel Jason Riggs, San Diego, CA (US); Robert Jay Rafac, Encinitas, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/859,042

(22) Filed: Apr. 27, 2020

(65) Prior Publication Data

US 2020/0260564 A1 Aug. 13, 2020

Related U.S. Application Data

(63) Continuation of application No. 16/391,890, filed on Apr. 23, 2019, now Pat. No. 10,674,591, which is a (Continued)

(51) Int. Cl.
*H05G 2/00* (2006.01)

(52) U.S. Cl.
CPC ..... *H05G 2/008* (2013.01)

(58) Field of Classification Search
CPC ..... H05J 2/008; H05G 2/008
See application file for complete search history.

(56) References Cited

U.S. PATENT DOCUMENTS 6,005,879 A 12/1999 Sandstrom et al.
8,000,212 B2 8/2011 Senekerimyan et al.
(Continued)

FOREIGN PATENT DOCUMENTS

CN 102971922 A 3/2013
CN 103064260 A 4/2013
(Continued)

OTHER PUBLICATIONS

Blaine R. Copenheaver, U.S. International Searching Authority, International Search Report and Written Opinion, counterpart PCT Application No. PCT/US2016/046301, dated Oct. 24, 2016, 15 pages total.

(Continued)

*Primary Examiner* — Nicole M Ippolito
*Assistant Examiner* — Hanway Chang
(74) *Attorney, Agent, or Firm* — DiBerardino McGovern IP Group LLC

(57) ABSTRACT

A method includes providing a target material that comprises a component that emits extreme ultraviolet (EUV) light when converted to plasma; directing a first beam of radiation toward the target material to deliver energy to the target material to modify a geometric distribution of the target material to form a modified target; directing a second beam of radiation toward the modified target, the second beam of radiation converting at least part of the modified target to plasma that emits EUV light; measuring one or more characteristics associated with one or more of the target material and the modified target relative to the first beam of radiation; and controlling an amount of radiant exposure delivered to the target material from the first beam of radiation based on the one or more measured characteristics to within a predetermined range of energies.

20 Claims, 13 Drawing Sheets

Related U.S. Application Data continuation of application No. 15/724,104, filed on Oct. 3, 2017, now Pat. No. 10,314,153, which is a continuation of application No. 14/824,141, filed on Aug. 12, 2015, now Pat. No. 9,820,368.

(56) References Cited

U.S. PATENT DOCUMENTS

| | | | | |
|---|---|---|---|---|
| 8,648,999 | B2 | 2/2014 | Graham et al. | |
| 8,681,427 | B2 | 3/2014 | Bergstedt et al. | |
| 8,791,440 | B1 | 7/2014 | Tao et al. | |
| 8,872,143 | B2 | 10/2014 | Rafac et al. | |
| 9,713,240 | B2 | 7/2017 | Riggs et al. | |
| 9,820,368 | B2 | 11/2017 | Riggs et al. | |
| 10,172,225 | B2 | 1/2019 | Suzuki et al. | |
| 10,314,153 | B2 | 6/2019 | Riggs et al. | |
| 10,674,591 | B2 * | 6/2020 | Riggs | H05G 2/008 |
| 2008/0013163 | A1 | 1/2008 | Leonardo et al. | |
| 2010/0181503 | A1 | 7/2010 | Yanagida et al. | |
| 2011/0317256 | A1 | 12/2011 | Hou et al. | |
| 2012/0170112 | A1 | 7/2012 | Sandstrom | |
| 2013/0062538 | A1 | 3/2013 | Kodama et al. | |
| 2013/0119232 | A1 | 5/2013 | Moriya et al. | |
| 2014/0218706 | A1 | 8/2014 | Wagner et al. | |
| 2014/0233005 | A1 | 8/2014 | Crouch et al. | |
| 2014/0264090 | A1 | 9/2014 | Rafac et al. | |
| 2015/0189728 | A1 | 7/2015 | Tao et al. | |
| 2015/0208494 | A1 | 7/2015 | Rafac et al. | |
| 2016/0073487 | A1 | 3/2016 | Yanagida et al. | |
| 2016/0234920 | A1 | 8/2016 | Suzuki et al. | |
| 2016/0255707 | A1 | 9/2016 | Ueda et al. | |

FOREIGN PATENT DOCUMENTS

| | | | |
|---|---|---|---|
| CN | 103748968 | A | 4/2014 |
| JP | 2011082473 | A | 4/2011 |
| JP | 2013062146 | A | 4/2013 |
| JP | 6744397 | B2 | 5/2013 |
| JP | 2013105725 | A | 5/2013 |
| WO | 2013075930 | A1 | 5/2013 |
| WO | 2014019803 | A1 | 2/2014 |
| WO | 2014143504 | A1 | 9/2014 |
| WO | 2014149435 | A1 | 9/2014 |
| WO | 2014149436 | A1 | 9/2014 |
| WO | 2015071066 | A1 | 5/2015 |
| WO | 2017027566 | A1 | 2/2017 |

OTHER PUBLICATIONS

J.R. Hoffman et al., "LLP EUV Conversion Efficiency Optimization," Emerging Lithographic Technologies IX, edited by R. Scott Mackay, Proceedings of SPIE vol. 5751 (SPIE, Bellingham, WA, 2005), copyright 2005, pp. 892-901.

Office Action, Examiner Wang Weining of the China National Intellectual Property Administration (The Patent Office of the People's Republic of China), counterpart Chinese Patent Application No. 2016800478680, dated Mar. 4, 2021, 7 pages total (including English translation of 4 pages).

Office Action and Search Report, Intellectual Property Office of Taiwan, counterpart Taiwanese Patent Application No. 105125348, dated Nov. 17, 2020, 9 pages total (including English translation of 4 pages).

Office Action, Japan Patent Office, counterpart Japanese Patent Application No. 2020-129631, dated May 20, 2021, 9 pages total (including English translation of 5 pages).

* cited by examiner

TARGET EXPANSION RATE CONTROL IN AN EXTREME ULTRAVIOLET LIGHT SOURCE

CROSS-REFERENCE TO RELATED APPLICATIONS

This application is a continuation of U.S. application Ser. No. 16/391,890, filed Apr. 23, 2019, titled TARGET EXPANSION RATE CONTROL IN AN EXTREME ULTRAVIOLET LIGHT SOURCE, and now allowed; which is a continuation of U.S. application Ser. No. 15/724,104, filed Oct. 3, 2017, titled TARGET EXPANSION RATE CONTROL IN AN EXTREME ULTRAVIOLET LIGHT SOURCE, and now issued as U.S. Pat. No. 10,314,153; which is a continuation of U.S. application Ser. No. 14/824,141, filed Aug. 12, 2015, titled TARGET EXPANSION RATE CONTROL IN AN EXTREME ULTRAVIOLET LIGHT SOURCE, and now issued as U.S. Pat. No. 9,820,368. All of these applications are incorporated herein by reference in their entirety.

TECHNICAL FIELD

The disclosed subject matter relates to controlling an expansion rate of a target material for a laser produced plasma extreme ultraviolet light source.

BACKGROUND

Extreme ultraviolet (EUV) light, for example, electromagnetic radiation having wavelengths of around 50 nm or less (also sometimes referred to as soft x-rays), and including light at a wavelength of about 13 nm, can be used in photolithography processes to produce extremely small features in substrates, for example, silicon wafers.

Methods to produce EUV light include, but are not necessarily limited to, converting a material that has an element, for example, xenon, lithium, or tin, with an emission line in the EUV range in a plasma state. In one such method, often termed laser produced plasma ("LPP"), the required plasma can be produced by irradiating a target material, for example, in the form of a droplet, plate, tape, stream, or cluster of material, with an amplified light beam that can be referred to as a drive laser. For this process, the plasma is typically produced in a sealed vessel, for example, a vacuum chamber, and monitored using various types of metrology equipment.

SUMMARY

In some general aspects, a method includes providing a target material that comprises a component that emits extreme ultraviolet (EUV) light when converted to plasma; directing a first beam of radiation toward the target material to deliver energy to the target material to modify a geometric distribution of the target material to form a modified target; directing a second beam of radiation toward the modified target, the second beam of radiation converting at least part of the modified target to plasma that emits EUV light; measuring one or more characteristics associated with one or more of the target material and the modified target relative to the first beam of radiation; and controlling an amount of radiant exposure delivered to the target material from the first beam of radiation based on the one or more measured characteristics to within a predetermined range of energies.

Implementations can include one or more of the following features. For example, the one or more characteristics associated with one or more of the target material and the modified target can be measured by measuring an energy of the first beam of radiation. The energy of the first beam of radiation can be measured by measuring the energy of the first beam of radiation reflected from an optically reflective surface of the target material. The energy of the first beam of radiation can be measured by measuring an energy of the first beam of radiation directed toward the target material. The energy of the first beam of radiation can be measured by measuring a spatially integrated energy across a direction perpendicular to a direction of propagation of the first beam of radiation.

The first beam of radiation can be directed toward the target material by overlapping the target material with an area of the first beam of radiation that encompasses its confocal parameter. The confocal parameter can be greater than 1.5 mm.

The one or more characteristics associated with one or more of the target material and the modified target can be measured by measuring a position of the target material relative to a target position. The target position can be coincident with a beam waist of the first beam of radiation. The first beam of radiation can be directed along a first beam axis, and the position of the target material can be measured along a direction that is parallel with the first beam axis. The target position can be measured relative to a primary focus of a collector device that collects the emitted EUV light. The position of the target material can be measured by measuring the position of the target material along two or more non-parallel directions.

The one or more characteristics associated with one or more of the target material and the modified target can be measured by detecting a size of the modified target before the second beam of radiation converts at least part of the modified target to plasma. The one or more characteristics associated with one or more of the target material and the modified target can be measured by estimating an expansion rate of the modified target.

The amount of radiant exposure delivered to the target material from the first beam of radiation can be controlled by controlling an expansion rate of the modified target.

The amount of radiant exposure delivered to the target material from the first beam of radiation can be controlled by determining whether a feature of the first beam of radiation should be adjusted based on the one or more measured characteristics. The determination that the feature of the first beam of radiation should be adjusted can be performed while the one or more characteristics are measured.

If it is determined that the feature of the first beam of radiation should be adjusted, then one or more of an energy content of a pulse of the first beam of radiation and an area of the first beam of radiation that interacts with the target material can be adjusted. The energy content of the pulse of the first beam of radiation can be adjusted by adjusting one or more of a pulse width of the first beam of radiation; a duration of the pulse of the first beam of radiation; and an average power within the pulse of the first beam of radiation.

The first beam of radiation can be directed toward the target material by directing pulses of first radiation toward the target material; the one or more characteristics can be measured by measuring the one or more characteristics for each pulse of first radiation; and it can be determining whether the feature of the first beam of radiation should be adjusted by determining for each pulse of first radiation whether the feature should be adjusted.

The radiant exposure delivered to the target material from the first beam of radiation can be controlled by controlling the radiant exposure delivered to the target material from the first beam of radiation while at least a portion of the emitted EUV light is exposing a wafer.

The target material can be provided by providing a droplet of target material; and the geometric distribution of the target material can be modified by transforming the droplet of the target material into a disk shaped volume of molten metal. The target material droplet can be transformed into the disk shaped volume in accordance with an expansion rate.

The method can also include collecting at least a portion of the emitted EUV light; and directing the collected EUV light toward a wafer to expose the wafer to the EUV light.

The one or more characteristics can be measured by measuring at least one characteristic for each pulse of the first beam of radiation directed toward the target material.

The first beam of radiation can be directed toward the target material so that a part of the target material is converted to plasma that emits EUV light, and less EUV light is emitted from the plasma converted from the target material than is emitted from the plasma converted from the modified target, and the pre-dominant action on the target material is the modification of the geometric distribution of the target material to form the modified target.

The geometric distribution of the target material can be modified by transforming a shape of the target material into the modified target including expanding the modified target along at least one axis according to an expansion rate. The amount of radiant exposure delivered to the target material can be controlled by controlling the expansion rate of the target material into the modified target.

The modified target can be expanded along the at least one axis, which is not parallel with the optical axis of the second beam of radiation.

The one or more characteristics associated with one or more of the target material and the modified target can be measured by measuring a number of photons reflected from the modified target. The number of photons reflected from the modified target can be measured by measuring the number of photons reflected from the modified target as a function of how many photons strike the target material.

The first beam of radiation can be directed toward the target material by directing pulses of first radiation toward the target material; and the second beam of radiation can be directed toward the modified target by directing pulses of second radiation toward the modified target.

The first beam of radiation can be directed by directing the first beam of radiation through a first set of one or more optical amplifiers; and the second beam of radiation can be directed by directing the second beam of radiation through a second set of one or more optical amplifiers; wherein at least one of the optical amplifiers in the first set is in the second set.

The one or more characteristics associated with one or more of the target material and the modified target can be measured by measuring an energy of the first beam of radiation directed toward the target material; and the amount of radiant exposure delivered to the target material can be controlled by adjusting an amount of energy directed to the target material from the first beam of radiation based on the measured energy. The first beam of radiation can be directed toward the target material by overlapping the target material with an area of the first beam of radiation that encompasses its confocal parameter; and the confocal parameter can be less than or equal to 2 mm.

The amount of energy directed to the target material from the first beam of radiation can be adjusted by adjusting a property of the first beam of radiation.

The amount of radiant exposure delivered to the target material from the first beam of radiation can be controlled by adjusting one or more of: an energy of the first beam of radiation just before the first beam of radiation delivers the energy to the target material; a position of the target material; and a region of the target material that interacts with the first beam of radiation.

The first beam of radiation can be directed by directing the first beam of radiation through a first set of optical components including one or more first optical amplifiers; and the second beam of radiation can be directed by directing the second beam of radiation through a second set of optical components including one or more second optical amplifiers; wherein the first set of optical components are distinct from and separated from the second set of optical components.

In other general aspects, an apparatus includes a chamber that defines an initial target location that receives a first beam of radiation and a target location that receives a second beam of radiation; a target material delivery system configured to provide target material to the initial target location, the target material comprising a material that emits extreme ultraviolet (EUV) light when converted to plasma; an optical source configured to produce the first beam of radiation and the second beam of radiation; and an optical steering system. The optical steering system is configured to: direct the first beam of radiation toward the initial target location to deliver energy to the target material to modify a geometric distribution of the target material to form a modified target, and direct the second beam of radiation toward the target location to convert at least part of the modified target to plasma that emits EUV light. The apparatus includes a measurement system that measures one or more characteristics associated with one or more of the target material and the modified target relative to the first beam of radiation; and a control system connected to the target material delivery system, the optical source, the optical steering system, and the measurement system. The control system is configured to receive the one or more measured characteristics from the measurement system and to send one or more signals to the optical source to control an amount of radiant exposure delivered to the target material from the first beam of radiation based on the one or more measured characteristics.

Implementations can include one or more of the following features. For example, the optical steering system can include a focusing apparatus configured to focus the first beam of radiation at or near the initial target location and to focus the second beam of radiation at or near the target location.

The apparatus can include a beam adjustment system, wherein the beam adjustment system is connected to the optical source and the control system, and the control system is configured to send one or more signals to the optical source to control the amount of energy delivered to the target material by sending one or more signals to the beam adjustment system, the beam adjustment system configured to adjust one or more features of the optical source to thereby maintain the amount of energy delivered to the target material. The beam adjustment system can include a pulse width adjustment system coupled to the first beam of radiation, the pulse width adjustment system configured to adjust a pulse width of the pulses of the first beam of radiation. The pulse width adjustment system can include an electro-optic modulator.

The beam adjustment system can include a pulse power adjustment system coupled to the first beam of radiation, the pulse power adjustment system configured to adjust an average power within pulses of the first beam of radiation. The pulse power adjustment system can include an acousto-optic modulator.

The beam adjustment system can be configured to send one or more signals to the optical source to control the amount of energy directed to the target material by sending one or more signals to the beam adjustment system, the beam adjustment system configured to adjust one or more features of the optical source to thereby control the amount of energy directed to the target material.

The optical source can include a first set of one or more optical amplifiers through which the first beam of radiation is passed; and a second set of one or more optical amplifiers through which the second beam of radiation is passed, at least one of the optical amplifiers in the first set is in the second set. The measurement system can measure an energy of the first beam of radiation as it is directed toward the initial target location; and the control system can be configured to receive the measured energy from the measurement system, and to send one or more signals to the optical source to control an amount of energy directed to the target material from the first beam of radiation based on the measured energy.

DRAWING DESCRIPTION

Figure 12:
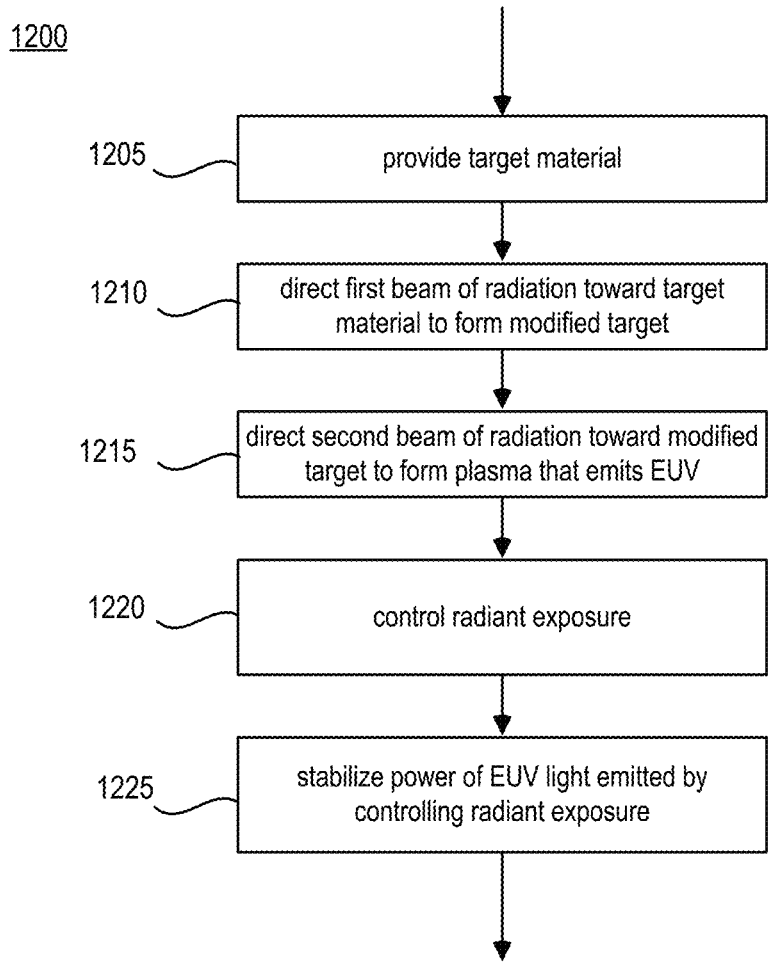
Figure 13:
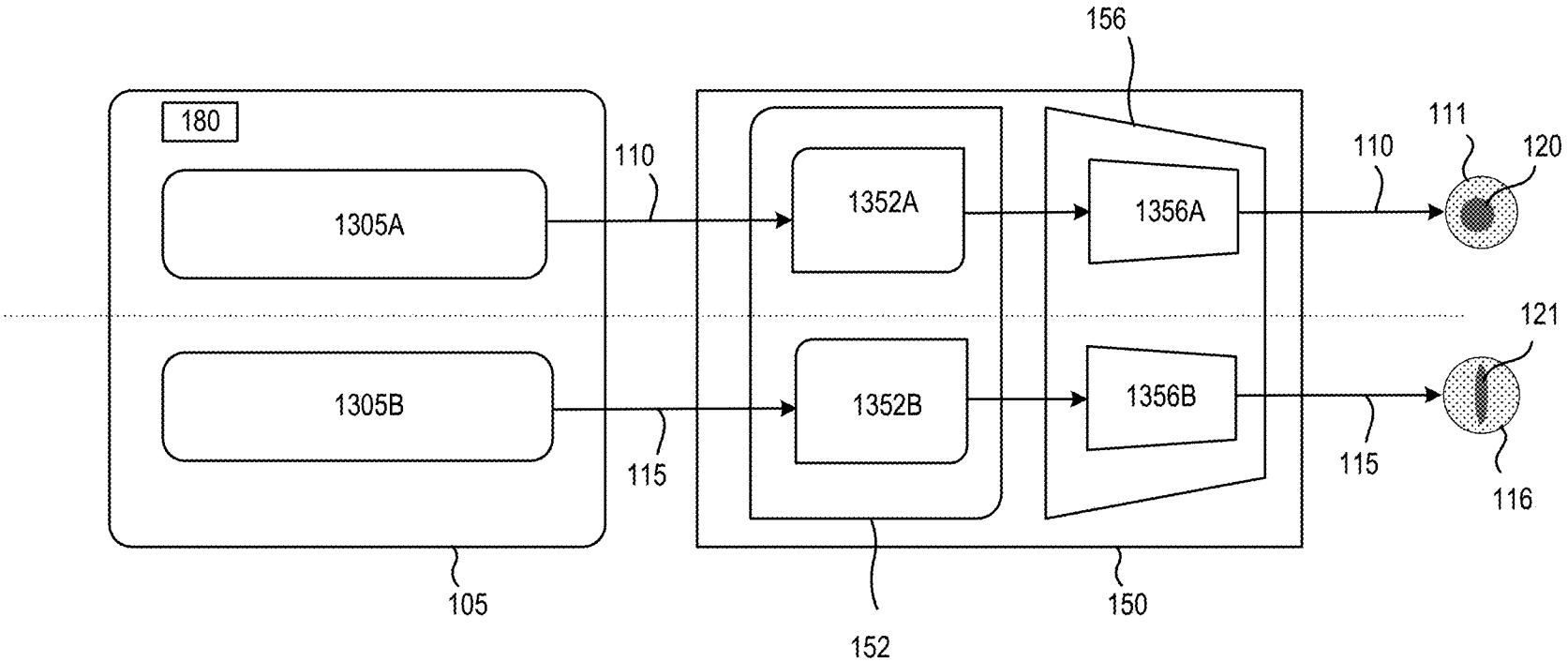

FIG. 12 is a flow chart of an exemplary procedure performed by the light source for stabilizing a power of EUV light emitted from the plasma by controlling the radiant exposure delivered to the target material from the first beam of radiation; and FIG. 13 is a block diagram of an exemplary optical source that produces first and second beams of radiation and an exemplary beam delivery system that modifies the first and second beams of radiation and focuses the first and second beams of radiation to respective first and second target locations.

DESCRIPTION

Figure 1:
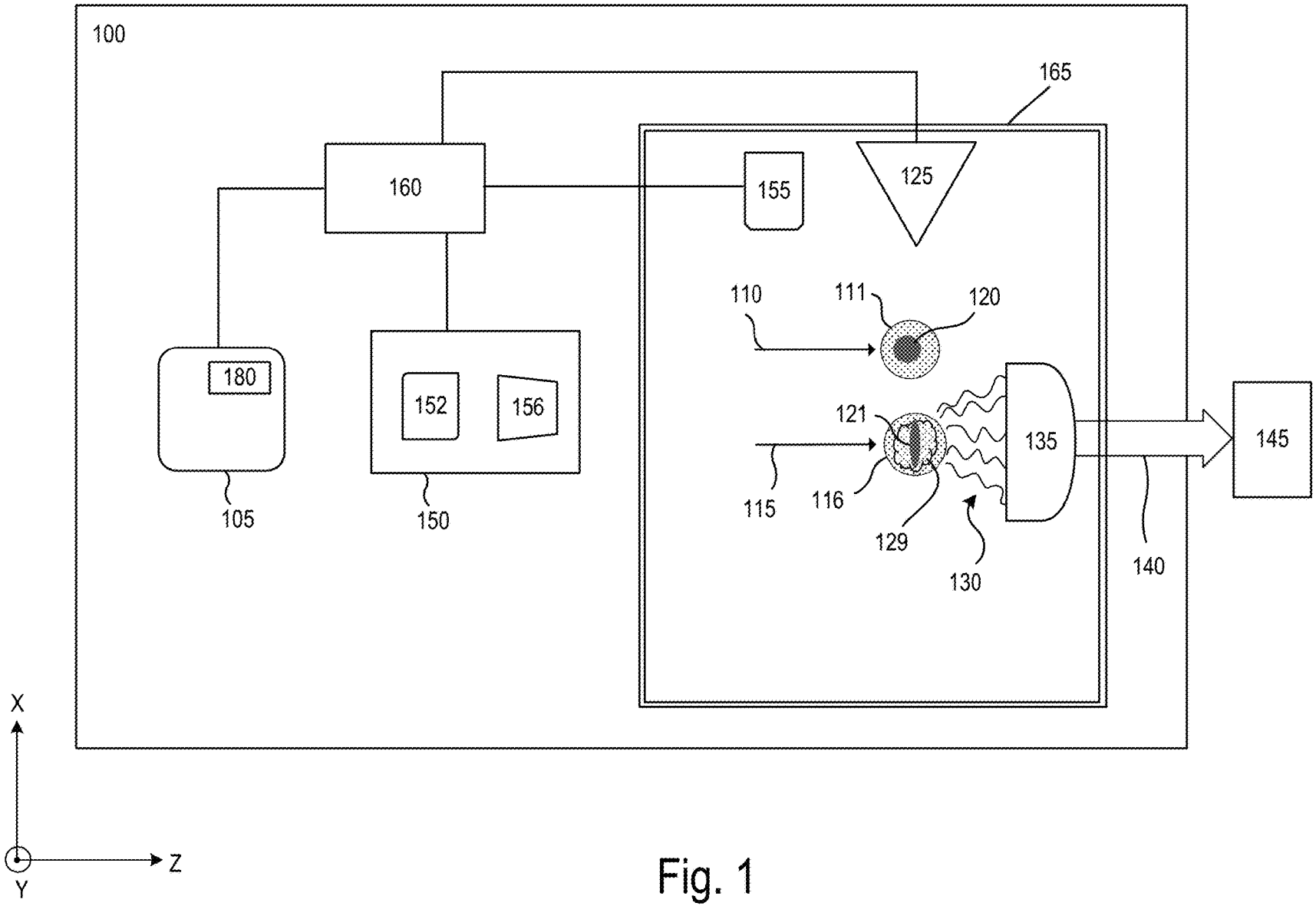
FIG. 1 is a block diagram of a laser produced plasma extreme ultraviolet light source including an optical source that produces a first beam of radiation directed to a target material and a second beam of radiation directed to a modified target to convert part of the modified target to plasma that emits EUV light.

Techniques for increasing the conversion efficiency of extreme ultraviolet (EUV) light production are disclosed. Referring to FIG. 1, and as discussed in more detail below, an interaction between a target material 120 and a first beam of radiation 110 causes the target material to deform and geometrically expand to thereby form a modified target 121. The geometric expansion rate of the modified target 121 is controlled in a manner that increases the amount of usable EUV light 130 converted from the plasma due to the interaction between the modified target 121 and a second beam of radiation 115. The amount of usable EUV light 130 is the amount of EUV light 130 that can be harnessed for use at an optical apparatus 145. Thus, the amount of usable EUV light 130 can depend on aspects such as the bandwidth or center wavelength of the optical components that are used to harness the EUV light 130.

The control of the geometric expansion rate of the modified target 121 enables control of a size or geometric aspect of the modified target 121 at the time that the modified target 121 interacts with the second beam of radiation 115. For example, adjustment of the geometric expansion rate of the modified target 121 adjusts a density of the modified target 121 at the time that it interacts with the second beam of radiation 115; because the density of the modified target 121 at the time that the modified target 121 interacts with the second beam of radiation 115 impacts a total amount of radiation absorbed by the modified target 121 and a range over which such radiation is absorbed. As the density of the modified target 121 increases, at some point the EUV light 130 would not be able to escape from the modified target 121 and thus the amount of usable EUV light 130 can drop. As another example, adjustment of the geometric expansion rate of the modified target 121 adjusts a surface area of the modified target 121 at the time that the modified target 121 interacts with the second beam of radiation 115.

In this way, the overall amount of usable EUV light 130 produced can be increased or controlled by controlling the expansion rate of the modified target 121. In particular, the size of the modified target 121 and its rate of expansion are dependent upon a radiant exposure applied to the target material 120 from the first beam of radiation 110, the radiant exposure being an amount of energy that is delivered to an area of the target material 120 by the first beam of radiation 110. Thus, the expansion rate of the modified target 121 can be maintained or controlled by maintaining or controlling the amount of energy that is delivered to the target material 120 per unit area. The amount of energy delivered to the target material 120 depends on the energy of the first beam of radiation 110 just before it impinges upon the surface of the target material.

The energy of the pulses in the first beam of radiation 110 can be determined by integrating the laser pulse signals measured by a fast photodetector. The detector can be a photoelectromagnetic (PEM) detector that is appropriate for long-wavelength infrared (LWIR) radiation, an InGaAs diode for measuring near-infrared (IR) radiation, or a silicon diode for visible or near-IR radiation.

The expansion rate of the modified target 121 depends, at least in part, on the amount of energy in the pulse of the first beam of radiation 110 that is intercepted by the target material 120. In a hypothetical baseline design, the target material 120 is assumed to be always the same size and placed in a waist of the focused first beam of radiation 110. In practice, though, the target material 120 may have a small but mostly constant axial position offset relative to a beam waist of the first beam of radiation 110. If all of these factors remain constant, then one factor that controls the expansion rate of the modified target 121 is the pulse energy of the first beam of radiation 110 for pulses of the first beam of radiation having a duration of a few to 100 ns. Another factor that can control the expansion rate of the modified target 121 if the pulses of the first beam of radiation 110 have a duration at or below 100 ns is the instantaneous peak power of the first beam of radiation 110. Other factors can control the expansion rate of the modified target 121 if the pulses of the first beam of radiation 110 have a duration that is shorter, for example, on the order of picoseconds (ps), as discussed below.

As shown in FIG. 1, an optical source 105 (also referred to as a drive source or a drive laser) is used to drive a laser produced plasma (LPP) extreme ultraviolet (EUV) light source 100. The optical source 105 produces a first beam of radiation 110 provided to a first target location 111 and a second beam of radiation 115 provided to a second target location 116. The first and second beams of radiation 110, 115 can be pulsed amplified light beams.

The first target location 111 receives a target material 120, such as tin, from a target material supply system 125. An interaction between the first beam of radiation 110 and the target material 120 delivers energy to the target material 120 to modify or change (for example, deform) its shape so that the geometric distribution of the target material 120 is deformed into a modified target 121. The target material 120 is generally directed from the target material supply system 125 along the −X direction or along a direction that places the target material 120 within the first target location 111. After the first beam of radiation 110 delivers energy to the target material 120 to deform it into the modified target 121, the modified target 121 can continue to move along the −X direction in addition to moving along another direction such as a direction that is parallel with the Z direction. As the modified target 121 moves away from the first target location 111, its geometric distribution continues to deform until the modified target 121 reaches the second target location 116. An interaction between the second beam of radiation 115 and the modified target 121 (at the second target location 116) converts at least part of the modified target 121 into plasma 129 that emits EUV light or radiation 130. A light collector system (or light collector) 135 collects and directs the EUV light 130 as collected EUV light 140 toward an optical apparatus 145 such as a lithography tool. The first and second target locations 111, 116 and the light collector 135 can be housed within a chamber 165 that provided a controlled environment suitable for production of EUV light 140.

It is possible for some of the target material 120 to be converted into plasma when it interacts with the first beam of radiation 110 and thus it is possible that such plasma can emit EUV radiation. However, the properties of the first beam of radiation 110 are selected and controlled so that the predominant action on the target material 120 by the first beam of radiation 110 is the deformation or modification of the geometric distribution of the target material 120 to form the modified target 121.

Each of the first beam of radiation 110 and the second beam of radiation 115 is directed toward the respective target locations 111, 116 by a beam delivery system 150. The beam delivery system 150 can include optical steering components 152 and a focus assembly 156 that focuses the first or second beam of radiation 110, 115 to respective first and second focal regions. The first and second focal regions can overlap with the first target location 111 and the second target location 116, respectively. The optical components 152 can include optical elements, such as lenses and/or mirrors, which direct the beam of radiation 110, 115 by refraction and/or reflection. The beam delivery system 150 can also include elements that control and/or move the optical components 152. For example, the beam delivery system 150 can include actuators that are controllable to cause optical elements within the optical components 152 to move.

Figure 2:
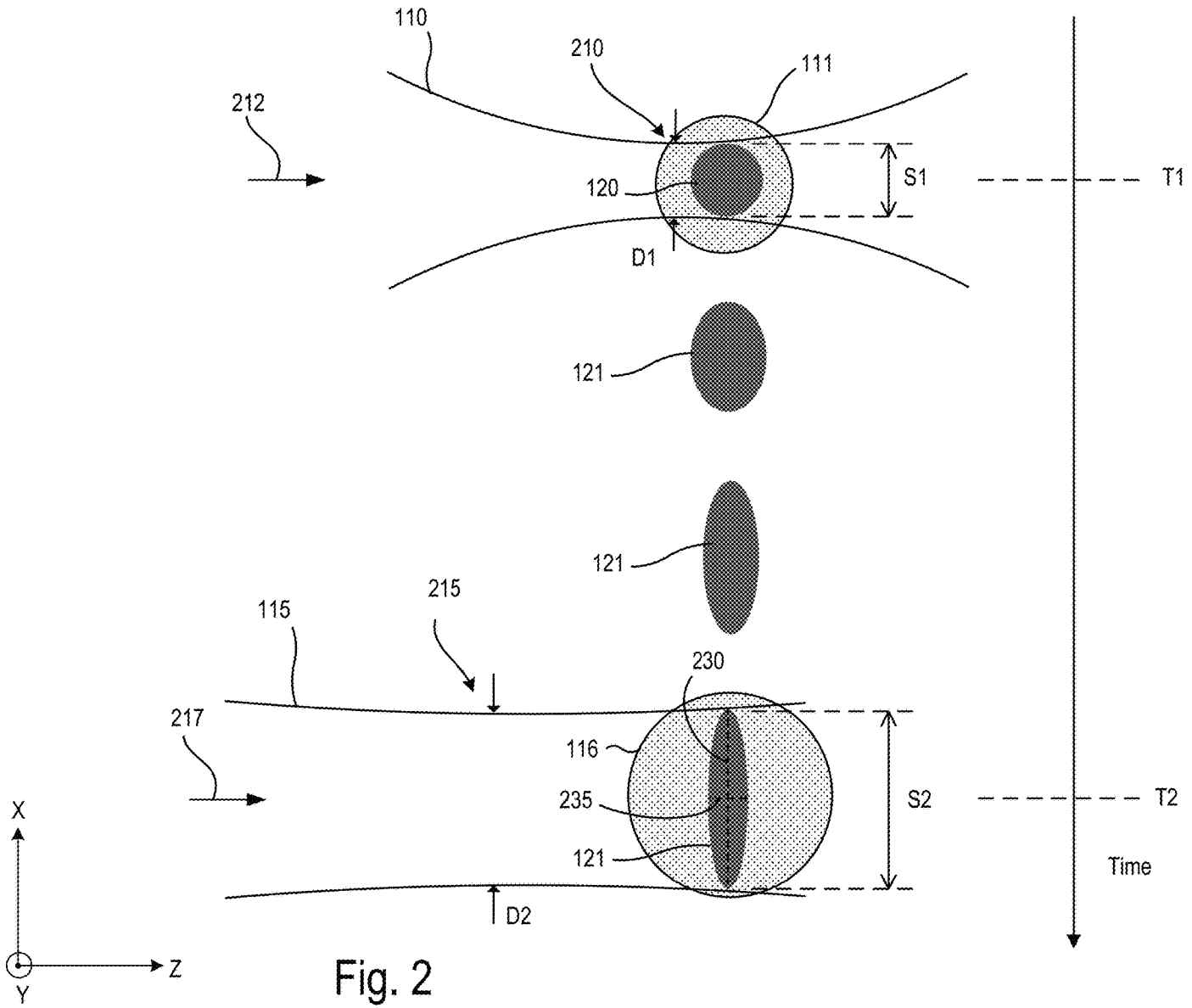
FIG. 2 is a schematic diagram showing the first beam of radiation directed to a first target location and the second beam of radiation directed to a second target location.

Referring also to FIG. 2, the focus assembly 156 focuses the first beam of radiation 110 so that the diameter D1 of the first beam of radiation 110 is at a minimum in a first focal region 210. In other words, the focus assembly 156 causes the first beam of radiation 110 to converge as it propagates toward the first focal region 210 in a first axial direction 212, which is the general direction of propagation of the first beam of radiation 110. The first axial direction 212 extends along a plane that is defined by the X-Z axes. In this example, the first axial direction 212 is parallel with or nearly parallel with the Z direction, but it can be along an angle relative to the Z. In the absence of a target material 120, the first beam of radiation 110 diverges as it propagates away from the first focal region 210 in the first axial direction 212.

Additionally, the focus assembly 156 focuses the second beam of radiation 115 so that the diameter D2 of the second beam of radiation 115 is at a minimum in the second focal region 215. Thus, the focus assembly causes the second beam of radiation 115 to converge as it propagates toward the second focal region 215 in a second axial direction 217, which is the general direction of propagation of the second beam of radiation 115. The second axial direction 217 also extends along a plane that is defined by the X-Z axes, and in this example, the second axial direction 217 is parallel with or nearly parallel with the Z direction. In the absence of a modified target 121, the second beam of radiation 115 diverges as it propagates away from the second focal region 215 along the second axial direction 217.

As discussed below, the EUV light source 100 also includes one or more measurement systems 155, a control system 160, and a beam adjustment system 180. The control system 160 is connected to other components within the light source 100 such as, for example, the measurement system 155, the beam delivery system 150, the target material supply system 125, the beam adjustment system 180, and the optical source 105. The measurement system 155 can measure one or more characteristics within the light source 100. For example, the one or more characteristics can be characteristics associated with the target material 120 or the modified target 121 relative to the first beam of radiation 110. As another example, the one or more characteristics can be a pulse energy of the first beam of radiation 110 that is directed toward the target material 120. These examples will be discussed in greater detail below. The control system 160 is configured to receive the one or more measured characteristics from the measurement system so that it can control how the first beam of radiation 110 interacts with the target material 120. For example, the control system 160 can be configured to maintain an amount of energy delivered to the target material 120 from the first beam of radiation 110 to within a predetermined range of energies. As another example, the control system 160 can be configured to control an amount of energy directed to the target material 120 from the first beam of radiation 110. The beam adjustment system 180 is a system that includes components within or components that adjust components within the optical source 105 to thereby control properties (such as a pulse width, pulse energy, instantaneous power within the pulses, or an average power within the pulses) of the first beam of radiation 110.

Figure 3A:
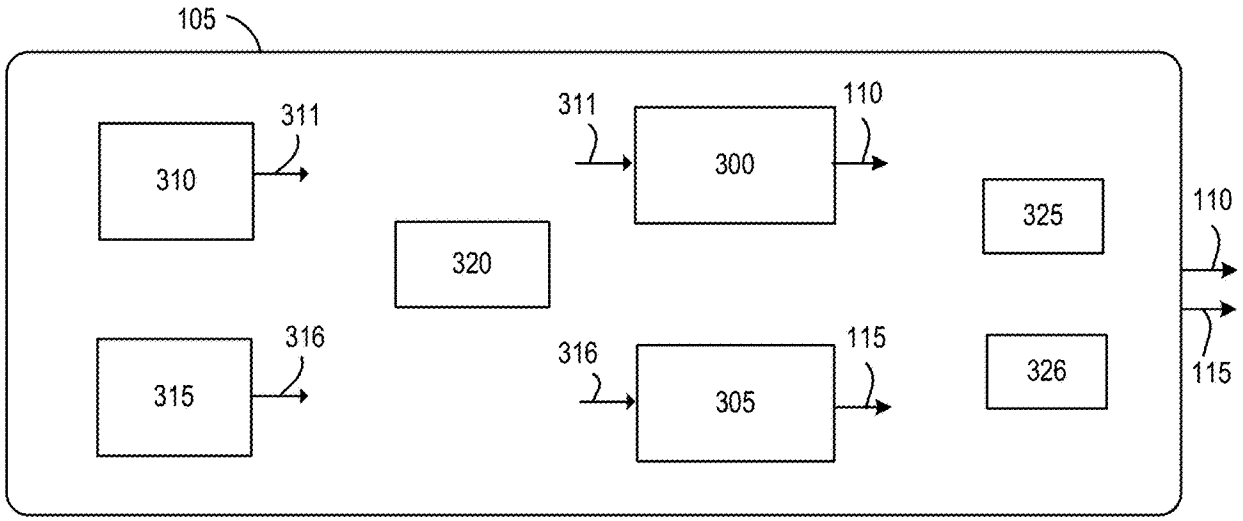
FIG. 3A is a block diagram of an exemplary optical source for use in the light source of FIG. 1.

Referring to FIG. 3A, in some implementations, the optical source 105 includes a first optical amplifier system 300 that includes a series of one or more optical amplifiers through which the first beam of radiation 110 is passed, and a second optical amplifier system 305 that includes a series of one or more optical amplifiers through which the second beam of radiation 115 is passed. One or more amplifiers from the first system 300 can be in the second system 305; or one or more amplifiers in the second system 305 can be in the first system 300. Alternatively, it is possible that the first optical amplifier system 300 is entirely separate from the second optical amplifier system 305.

Additionally, though not required, the optical source 105 can include a first light generator 310 that produces a first pulsed light beam 311 and a second light generator 315 that produces a second pulsed light beam 316. The light generators 310, 315 can each be, for example, a laser, a seed laser such as a master oscillator, or a lamp. An exemplary light generator that can be used as the light generator 310, 315 is a Q-switched, radio frequency (RF) pumped, axial flow, carbon dioxide ($CO_2$) oscillator that can operate at a repetition rate of, for example, 100 kHz.

The optical amplifiers within the optical amplifier systems 300, 305 each contain a gain medium on a respective beam path, along which a light beam 311, 316 from the respective light generator 310, 315 propagates. When the gain medium of the optical amplifier is excited, the gain medium provides photons to the light beam, amplifying the light beam 311, 316 to produce the amplified light beam that forms the first beam of radiation 110 or the second beam of radiation 115.

The wavelengths of the light beams 311, 316 or the beams of radiation 110, 115 can be distinct from each other so that the beams of radiation 110, 115 can be separated from each other, if they are combined at any point within the optical source 105. If the beams of radiation 110, 115 are produced by $CO_2$ amplifiers, then the first beam of radiation 110 can have a wavelength of 10.26 micrometers (μm) or 10.207 μm, and the second beam of radiation 115 can have a wavelength of 10.59 μm. The wavelengths are chosen to more easily enable separation of the two beams of radiation 110, 115 using dispersive optics or dichroic mirror or beamsplitter coatings. In the situation in which both beams of radiation 110, 115 propagate together in the same amplifier chain (for example, a situation in which some of the amplifiers of optical amplifier system 300 are in the optical amplifier system 305), then the distinct wavelengths can be used to adjust a relative gain between the two beams of radiation 110, 115 even though they are traversing through the same amplifiers.

For example, the beams of radiation 110, 115, once separated, could be steered or focused to two separate locations (such as the first and second target locations 111, 116, respectively) within the chamber 165. In particular, the separation of the beams of radiation 110, 115 also enables the modified target 121 to expand after interacting with the first beam of radiation 110 while it travels from the first target location 111 to the second target location 116.

Figure 3B:
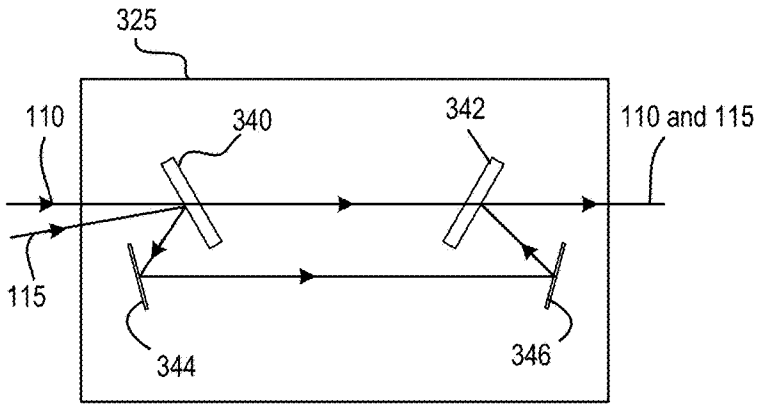
FIGS. 3B and 3C are block diagrams of, respectively, an exemplary beam path combiner and an exemplary beam path separator that can be used in the optical source of FIG. 1.

The optical source 105 can include a beam path combiner 325 that overlays the first beam of radiation 110 and the second beam of radiation 115 and places the beams of radiation 110, 115 on the same optical path for at least some of the distance between the optical source 105 and the beam delivery system 150. An exemplary beam path combiner 325 is shown in FIG. 3B. The beam path combiner 325 includes a pair of dichroic beam splitters 340, 342 and a pair of mirrors 344, 346. The dichroic beam splitter 340 enables the first beam of radiation 110 to pass through along a first path that leads to the dichroic beam splitter 342. The dichroic beam splitter 340 reflects the second beam of radiation 115 along a second path in which the second beam of radiation 115 is reflected from the mirrors 344, 346, which redirect the second beam of radiation 115 toward the dichroic beam splitter 342. The first beam of radiation 110 freely passes through the dichroic beam splitter 342 onto an output path while the second beam of radiation 115 is reflected from the dichroic beam splitter 342 onto the output path so that both the first and second beam of radiation 110, 115 overlay on the output path.

Figure 3C:
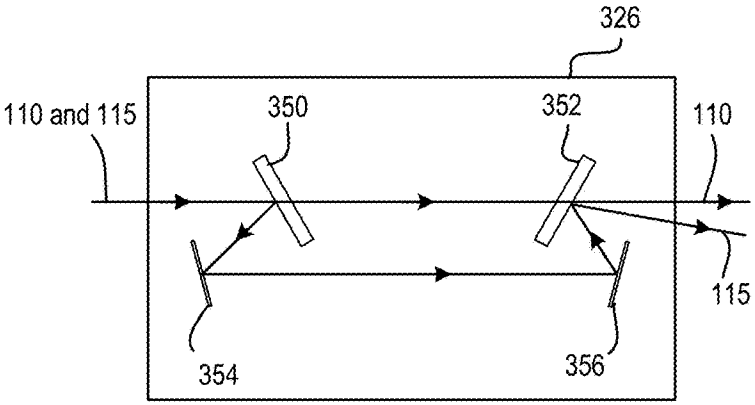

Additionally, the optical source 105 can include a beam path separator 326 that separates the first beam of radiation 110 from the second beam of radiation 115 so that the two beams of radiation 110, 115 could be separately steered and focused within the chamber 165. An exemplary beam path separator 326 is shown in FIG. 3C. The beam path separator 326 includes a pair of dichroic beam splitters 350, 352 and a pair of mirrors 354, 356. The dichroic beam splitter 350 receives the overlaid pair of beams of radiation 110, 115, reflects the second beam of radiation 115 along a second path, and transmits the first beam of radiation 110 along a first path toward the dichroic beam splitter 352. The first beam of radiation 110 freely passes through the dichroic beam splitter 352 along the first path. The second beam of radiation 115 reflects from the mirrors 354, 356 and returns to the dichroic beam splitter 352, where it is reflected onto a second path that is distinct from the first path.

Additionally, the first beam of radiation 110 can be configured to have less pulse energy than the pulse energy of the second beam of radiation 115. This is because the first beam of radiation 110 is used to modify the geometry of the target material 120 while the second beam of radiation 115 is used to convert the modified target 121 into plasma 129. For example, the pulse energy of the first beam of radiation 110 can be 5-100 times less than the pulse energy of the second beam of radiation 115.

Figure 4A:
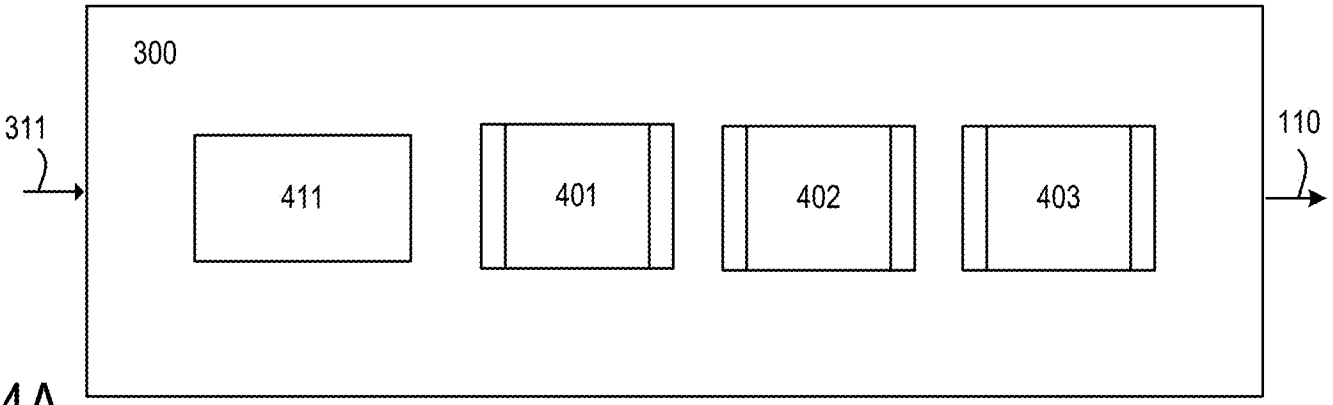
FIGS. 4A and 4B are block diagrams of exemplary optical amplifier systems that can be used in the optical source of FIG. 3A.
Figure 4B:
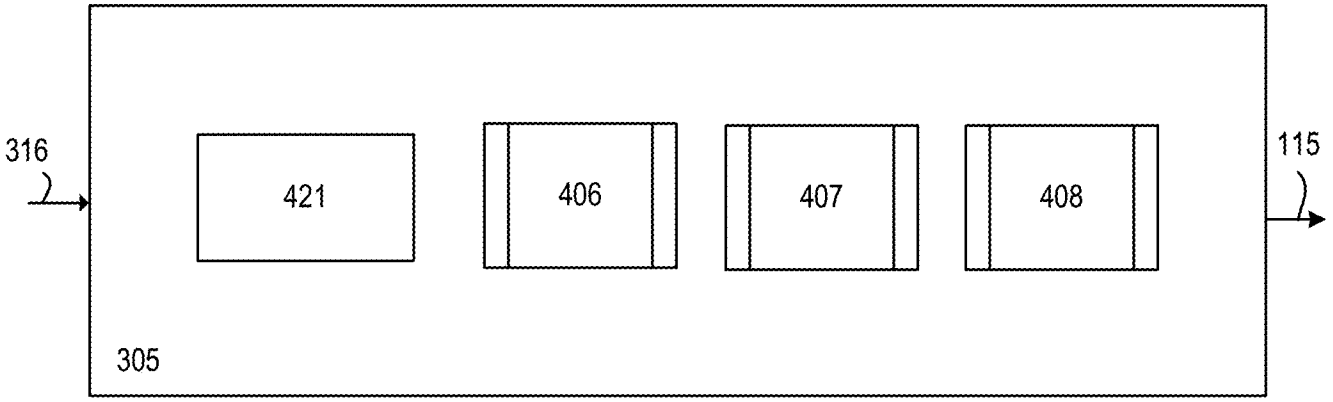

In some implementations, as shown in FIGS. 4A and 4B, the optical amplifier system 300 or 305 includes a set of three optical amplifiers 401, 402, 403 and 406, 407, 408, respectively, though as few as one amplifier or more than three amplifiers can be used. In some implementations, each of the optical amplifiers 406, 407, 408 includes a gain medium that includes $CO_2$ and can amplify light at a wavelength of between about 9.1 and about 11.0 μm, and in particular, at about 10.6 μm, at a gain greater than 1000. It is possible for the optical amplifiers 401, 402, 403 to be operated similarly or at different wavelengths. Suitable amplifiers and lasers for use in the optical amplifier systems 300, 305 can include a pulsed laser device such as a pulsed gas-discharge $CO_2$ amplifier producing radiation at about 9.3 μm or about 10.6 μm, for example, with DC or RF excitation, operating at relatively high power, for example, 10 kW or higher and high pulse repetition rate, for example, 50 kHz or more. Exemplary optical amplifiers 401, 402, 403 or 406, 407, 408 are axial flow high-power CO2 lasers with wear-free gas circulation and capacitive RF excitation such as the TruFlow $CO_2$ laser produced by TRUMPF Inc. of Farmington, Conn.

Additionally, though not required, one or more of the optical amplifier systems 300 and 305 can include a first amplifier that acts as a pre-amplifier 411, 421, respectively. The pre-amplifier 411, 421, if present, can be a diffusion-cooled $CO_2$ laser system such as the TruCoax $CO_2$ laser system produced by TRUMPF Inc. of Farmington, Conn.

The optical amplifier systems 300, 305 can include optical elements that are not shown in FIGS. 4A and 4B for directing and shaping the respective light beams 311, 316. For example, the optical amplifier systems 300, 305 can include reflective optics such as mirrors, partially-transmissive optics such as beam splitters or partially-transmissive mirrors, and dichroic beam splitters.

The optical source 105 also includes an optical system 320 that can include one or more optics (such as reflective optics such as mirrors, partially reflective and partially transmissive optics such as beamsplitters, refractive optics such as prisms or lenses, passive optics, active optics, etc.) for directing the light beams 311, 316 through the optical source 105.

Figure 5:
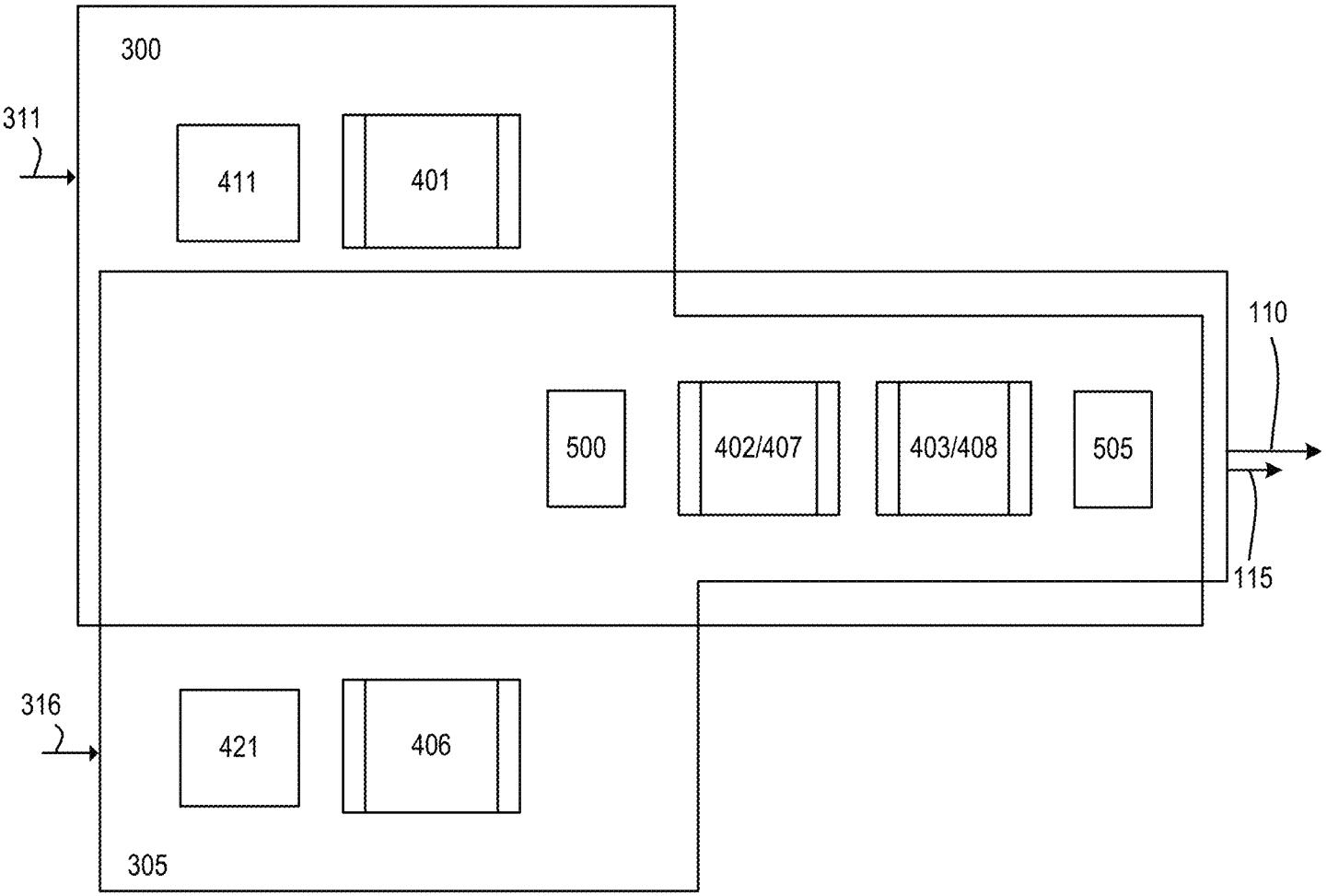
FIG. 5 is a block diagram of exemplary optical amplifier systems that can be used in the optical source of FIG. 3A.

Although the optical amplifiers 401, 402, 403 and 406, 407, 408 are shown as separate blocks, it is possible for at least one of the amplifiers 401, 402, 403 to be in the optical amplifier system 305 and for at least one of the amplifiers 406, 407, 408 to be in the optical amplifier system 300. For example, as shown in FIG. 5, the amplifiers 402, 403 correspond to the respective amplifiers 407, 408, and the optical amplifier systems 300, 305 include an additional optical element 500 (such as the beam path combiner 325) for combining the two light beams output from the amplifiers 401, 406 into a single path that passes through amplifier 402/407 and amplifier 403/408. In such a system in which at least some of the amplifiers and optics overlap between the optical amplifier systems 300, 305, it is possible that the first beam of radiation 110 and the second beam of radiation 115 are coupled together such that changes of one or more characteristics of the first beam of radiation 110 can cause changes to one or more characteristics of the second beam of radiation 115, and vice versa. Thus, it becomes even more important to control energy, such as the energy of the first beam of radiation 110 or the energy delivered to the target material 120, within the system. Additionally, the optical amplifier systems 300, 305 also include an optical element 505 (such as the beam path separator 326) for separating the two light beams 110, 15 output from the amplifier 403/408 to enable the two light beams 110, 115 to be directed to respective target locations 111, 116.

The target material 120 can be any material that includes target material that emits EUV light when converted to plasma. The target material 120 can be a target mixture that includes a target substance and impurities such as non-target particles. The target substance is the substance that can be converted to a plasma state that has an emission line in the EUV range. The target substance can be, for example, a droplet of liquid or molten metal, a portion of a liquid stream, solid particles or clusters, solid particles contained within liquid droplets, a foam of target material, or solid particles contained within a portion of a liquid stream. The target substance can be, for example, water, tin, lithium, xenon, or any material that, when converted to a plasma state, has an emission line in the EUV range. For example, the target substance can be the element tin, which can be used as pure tin (Sn); as a tin compound, for example, SnBr4, SnBr2, SnH4; as a tin alloy, for example, tin-gallium alloys, tin-indium alloys, tin-indium-gallium alloys, or any combination of these alloys. Moreover, in the situation in which there are no impurities, the target material includes only the target substance. The discussion below provides an example in which the target material 120 is a droplet made of molten metal such as tin. However, the target material 120 can take other forms.

The target material 120 can be provided to the first target location 111 by passing molten target material through a nozzle of the target material supply apparatus 125, and allowing the target material 120 to drift into the first target location 111. In some implementations, the target material 120 can be directed to the first target location 111 by force.

The shape of the target material 120 is changed or modified (for example, deformed) before reaching the second target location 116 by irradiating the target material 120 with a pulse of radiation from the first beam of radiation 110.

The interaction between the first beam of radiation 110 and the target material 120 causes material to ablate from the surface of the target material 120 (and the modified target 121) and this ablation provides a force that deforms the target material 120 into the modified target 121 that has a shape that is different than the shape of the target material 120. For example, the target material 120 can have a shape that is similar to a droplet, while the shape of the modified target 121 deforms so that its shape is closer to the shape of a disk (such as a pancake shape) when it reaches the second target location 116. The modified target 121 can be a material that is not ionized (a material that is not a plasma) or that is minimally ionized. The modified target 121 can be, for example, a disk of liquid or molten metal, a continuous segment of target material that does not have voids or substantial gaps, a mist of micro- or nano-particles, or a cloud of atomic vapor. For example, as shown in FIG. 2, the modified target 121 expands after about a time T2−T1 (which can be on the order of microseconds (μs)) into a disk shaped piece of molten metal 121 within the second target location 116.

Additionally, the interaction between the first beam of radiation 110 and the target material 120 that causes the material to ablate from the surface of the target material 120 (and modified target 121) can provide a force that can cause the modified target 121 to acquire some propulsion or speed along the Z direction. The expansion of the modified target 121 in the X direction and the acquired speed in the Z direction depend on an energy of the first beam of radiation 110, and in particular, on the energy delivered to (that is, intercepted by) the target material 120.

For example, for a constant target material 120 size and for long pulses of the first beam of radiation 110 (a long pulse being a pulse having a duration between a few nanoseconds (ns) and 100 ns) then the expansion rate is linearly proportional to the energy per unit area (Joules/$cm^2$) of the first beam of radiation 110. The energy per unit area is also referred to as the radiant exposure or fluence. The radiant exposure is the radiant energy received by the surface of the target material 120 per unit area, or equivalently irradiance of the surface of the target material 120 integrated over the time that the target material 120 is irradiated.

As another example, for a constant target material 120 size and for short pulses (those having durations of less than a few hundred picoseconds (ps)), then the relationship between the expansion rate and the energy of the first beam of radiation 110 can be different. In this regime, the shorter pulse duration correlates to an increase in intensity of the first beam of radiation 110 that interacts with the target material 120 and the first beam of radiation 110 behaves like a shock wave. In this regime, the expansion rate depends predominantly on the intensity I of the first beam of radiation 110, and the intensity is equal to the energy E of the first beam of radiation divided by the spot size (the cross-sectional area A) of the first beam of radiation 110 that interacts with the target material 120 and the pulse duration ($\tau$), or $I=E/(A\cdot\tau)$. In this ps-pulse duration regime, the modified target 121 expands so as to form a mist.

Additionally, the angular orientation (the angle relative to the Z direction or the X direction) of the disk shape of the modified target 121 depends on the position of the first beam of radiation 110 as it strikes the target material 120. Thus, if the first beam of radiation 110 strikes the target material 120 such that the first beam of radiation 110 encompasses the target material and the beam waist of the first beam of radiation 110 is centered on the target material 120, then it is more likely that the disk shape of the modified target 121 will be aligned with its long axis 230 parallel with the X direction and its short axis 235 parallel with the Z direction.

The first beam of radiation 110 is made up of pulses of radiation, and each pulse can have a duration. Similarly, the second beam of radiation 115 is made up of pulses of radiation, and each pulse can have a duration. The pulse duration can be represented by the full width at a percentage (for example, half) of the maximum, that is, the amount of time that the pulse has an intensity that is at least the percentage of the maximum intensity of the pulse. However, other metrics can be used to determine the pulse duration. The pulse duration of the pulses within the first beam of radiation 110 can be, for example, 30 nanoseconds (ns), 60 ns, 130 ns, 50-250 ns, 10-200 picoseconds (ps), or less than 1 ns. The energy of the first beam of radiation 110 can be, for example, 1-100 milliJoules (mJ). The wavelength of the first beam of radiation 110 can be, for example, 1.06 μm, 1-10.6 μm, 10.59 μm, or 10.26 μm.

As discussed above, the expansion rate of the modified target 121 depends on the radiant exposure (the energy per unit area) of the first beam of radiation 110 that intercepts the target material 120. Thus, for a pulse of the first beam of radiation 110 having a duration of about 60 ns and about 50 mJ of energy, the actual radiant exposure depends on how tightly the first beam of radiation 110 is focused at the first focal region 210. In some examples, the radiant exposure can be about 400-700 Joules/cm$^2$ at the target material 120. However, the radiant exposure is very sensitive to the location of the target material 120 relative to the first beam of radiation 110.

The second beam of radiation 115 can be referred to as the main beam and it is made up of pulses that are released at a repetition rate. The second beam of radiation 115 has sufficient energy to convert target substance within the modified target 121 into plasma that emits EUV light 130. The pulses of the first beam of radiation 110 and the pulses of the second beam of radiation 115 are separated in time by a delay time such as, for example, 1-3 microseconds (μs), 1.3 μs, 1-2.7 μs, 3-4 μs, or any amount of time that allows expansion of the modified target 121 into the disk shape of desired size that is shown in FIG. 2. Thus, the modified target 121 undergoes a two-dimensional expansion as the modified target 121 expands and elongates in the X-Y plane.

Figure 6:
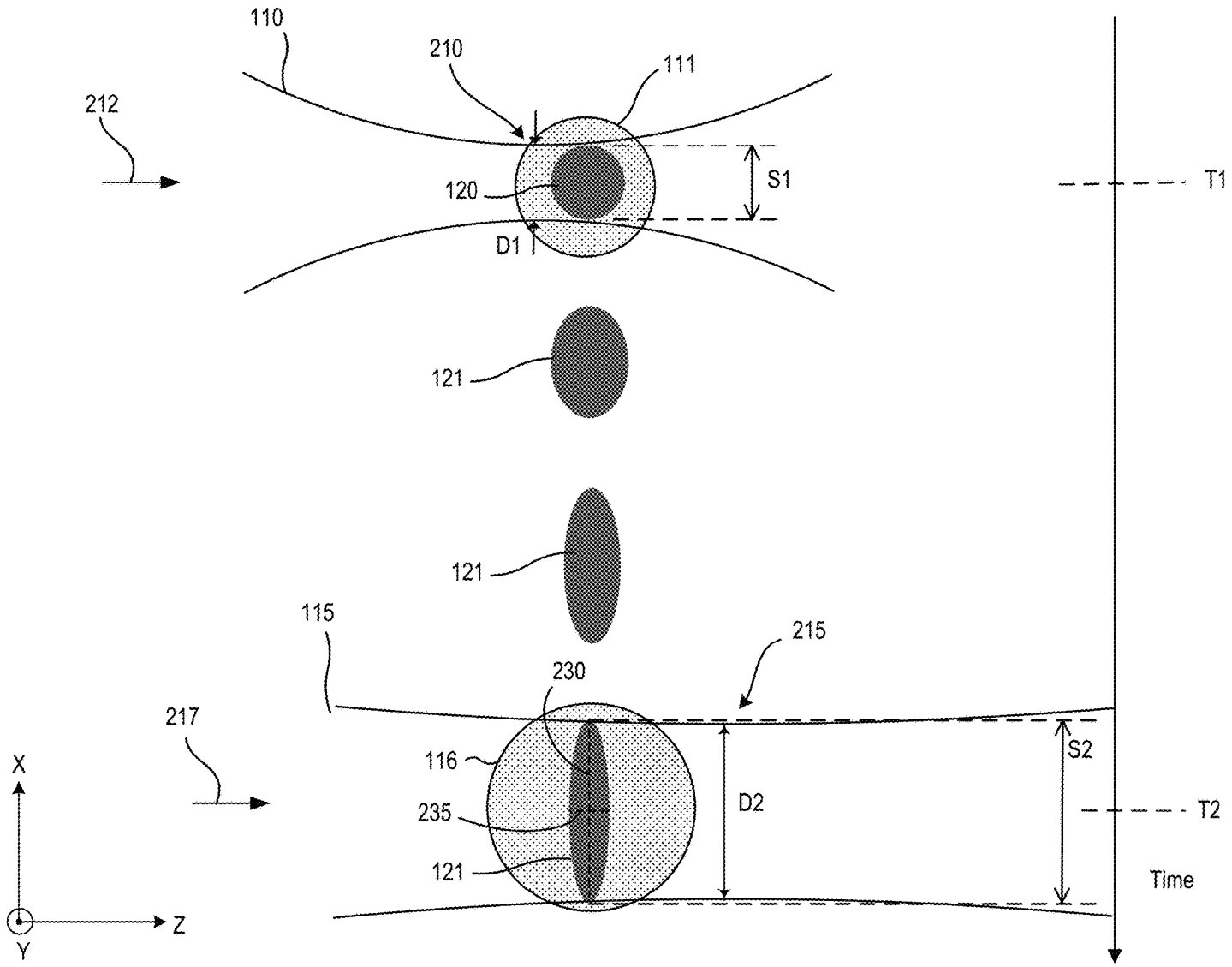
FIG. 6 is a schematic diagram showing another implementation of the first beam of radiation directed to the first target location and the second beam of radiation directed to the second target location.

The second beam of radiation 115 can be configured so that it is slightly defocused as it strikes the modified target 121. Such a defocus scheme is shown in FIG. 2. In this case, the second focal region 215 is at a different location along the Z direction from the long axis 230 of the modified target 121; moreover, the second focal region 215 is outside of the second target location 116. In this scheme, the second focal region 215 is placed before the modified target 121 along the Z direction. That is, the second beam of radiation 115 comes to a focus (or beam waist) before the second beam of radiation 115 strikes the modified target 121. Other defocus schemes are possible. For example, as shown in FIG. 6, the second focal region 215 is placed after the modified target 121 along the Z direction. In this way, the second beam of radiation 115 comes to a focus (or beam waist) after the second beam of radiation 115 strikes the modified target 121.

Referring again to FIG. 2, the rate at which the modified target 121 expands as it moves (for example, drifts) from the first target location 111 to the second target location 116 can be referred to as the expansion rate (ER). At the first target location 111, just after the target material 120 is struck by the first beam of radiation 110 at time T1, the modified target 121 has an extent (or length) S1 taken along the long axis 230. As the modified target 121 reaches the second target location 116 at time T2, the modified target 121 has an extent of S2 taken along the long axis 230. The expansion rate is the difference in the extent (S2−S1) of the modified target 121 taken along the long axis 230 divided by the difference in the time (T2−T1), thus:

$$ER = \frac{S2 - S1}{T2 - T1}.$$

Although the modified target 121 expands along the long axis 230, it is also possible for the modified target 121 to compress or thin along the short axis 235.

The two-stage approach discussed above, in which a modified target 121 is formed by interacting the first beam of radiation 110 with the target material 120, and then the modified target 121 is converted to plasma by interacting the modified target 121 with the second beam of radiation 115, leads to a conversion efficiency of about 3-4%. In general, it is desired to increase the conversion of the light from the optical source 105 into EUV radiation 130 because too low a conversion efficiency can require an increase in the amount of power the optical source 105 needs to deliver, which, increases the cost for operating the optical source 105 and also increases the thermal load on all the components within the light source 100, and can lead to increased debris generation within a chamber that houses the first and second target locations 111, 116. An increase in the conversion efficiency can help to meet the requirements for a high-volume manufacturing tool and at the same time keep the optical source power requirements within acceptable limits. Various parameters impact the conversion efficiency, such as, for example, the wavelength of the first and second beams of radiation 110, 115, the target material 120, and the pulse shapes, energy, power, and intensity of the beams of radiation 110, 115. The conversion efficiency can be defined as the EUV energy produced by the EUV light 130 into a steradian and 2% bandwidth around the center wavelength of the reflectivity curves of the (multilayer) mirrors used in either or both the light collector system 135 and the illumination and projection optics in the optical apparatus 145 divided by the energy of the irradiating pulse of the second beam of radiation 115. In one example, the center wavelength of the reflectivity curves is 13.5 nanometers (nm).

One way to increase, maintain, or optimize the conversion efficiency is to control or stabilize the energy of the EUV light 130, and to do this, it becomes important to maintain, among other parameters, the expansion rate of the modified target 121 to within an acceptable range of values. The expansion rate of the modified target 121 is maintained within an acceptable range of values by maintaining the radiant exposure on the target material 120 from the first beam of radiation 110. And, the radiant exposure can be maintained based on one or more measured characteristics associated with the target material 120 or the modified target 121 relative to the first beam of radiation 110. The radiant exposure is the radiant energy received by the surface of the target material 120 per unit area. Thus, the radiant exposure can be estimated or approximated as the amount of energy directed toward the surface of the target material 120 if the area of the target material 120 remains constant from pulse to pulse.

There are different methods or techniques to maintain the expansion rate of the modified target 121 to within an acceptable range of values. And, the method or technique that is used can depend on certain properties associated with the first beam of radiation 110. The conversion efficiency is also impacted by other parameters, such as the size or thickness of the target material 120, the position of the target material 120 relative to the first focal region 210, or the angle of the target material 120 relative to an x-y plane.

One property that can impact how the radiant exposure is maintained is the confocal parameter of the first beam of radiation 110. The confocal parameter of a beam of radiation is twice the Rayleigh length of the beam of radiation, and the Raleigh length is the distance along the propagation direction of the beam of radiation from the waist to the place where the area of the cross section is doubled. Referring to FIG. 2, for the beam of radiation 110, the Rayleigh length is the distance along the propagation direction 212 of the first beam of radiation 110 from its waist (which is D1/2) to a place at which the cross section of the first beam is doubled.

Figure 7A:
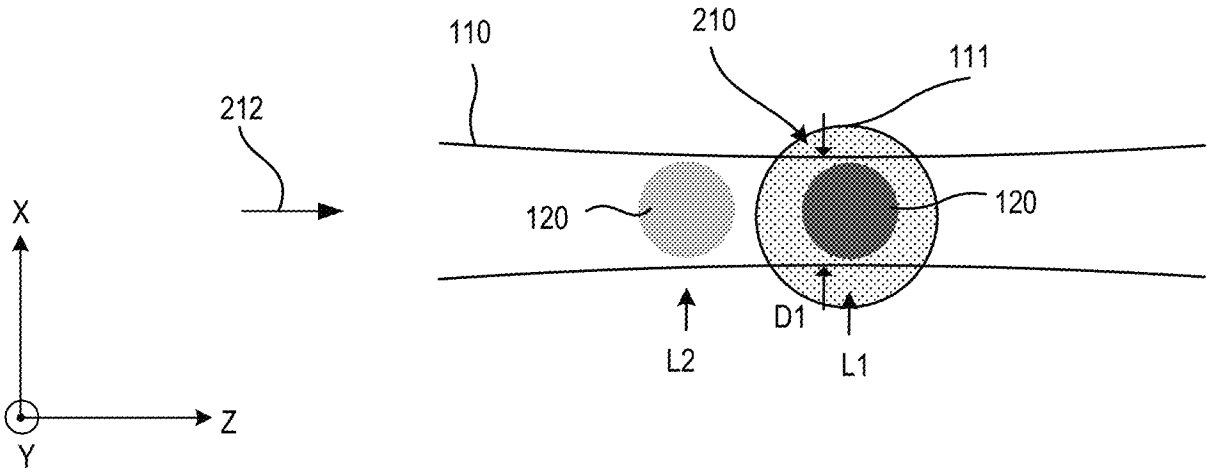
FIGS. 7A and 7B are schematic diagrams showing implementations of the first beam of radiation directed to the first target location.

For example, as shown in FIG. 7A, the confocal parameter of the first beam of radiation 110 is so long that the beam waist (D1/2) easily encompasses the target material 120 and the area (that is measured across the X direction) of the surface of the target material 120 that is intercepted by the first beam of radiation 110 remains relatively constant even if the position of the target material 120 deviates from the location of the beam waist D1/2. For example, the area of the surface of the target material 120 that is intercepted by the first beam of radiation 110 at location L1 is within 20% of the area of the surface of the target material 120 that is intercepted by the first beam of radiation 110 at location L2. In this first scenario in which the area of the surface of the target material 120 intercepted by the first beam of radiation 110 is less likely to deviate from an average value (as compared to a second scenario described below), the radiant exposure and thus the expansion rate can be maintained or controlled by maintaining an amount of energy that is directed to the target material 120 from the first beam of radiation 110 (without having to factor in the surface area of the target material 120 exposed by the first beam of radiation 110).

Figure 7B:
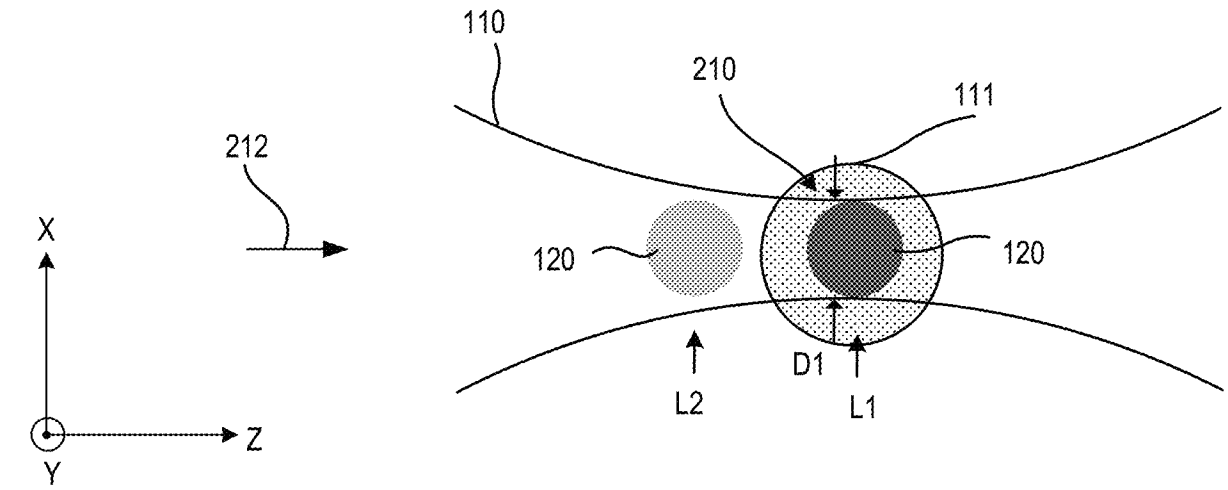

As another example, as shown in FIG. 7B, the confocal parameter of the first beam of radiation 110 is so short that the beam waist (D1/2) does not encompass the target material 120 and the area of the surface of the target material 120 intercepted by the first beam of radiation 110 deviates from an average value if the position of the target material 120 deviates from the location L1 of the beam waist D1/2. For example, the area of the surface of the target material 120 intercepted by the first beam of radiation 110 at location L1 is substantially different from the area of the surface of the target material 120 intercepted by the first beam of radiation 110 at location L2. In this second scenario in which the area of the surface of the target material 120 intercepted by the first beam of radiation 110 is more likely to deviate from an average value (than in the first scenario), the radiant exposure and thus the expansion rate can be maintained or controlled by controlling the amount of energy that delivered to the target material 120 from the first beam of radiation 110. In order to control the radiant exposure, the radiant energy of the first beam of radiation 110 that is received by the surface of the target material 120 per unit area is controlled. Thus, it is important to control the energy of the pulses of the first beam of radiation 110 and the area of the first beam of radiation 110 where the target material 120 intercepts the first beam of radiation 110. The area of the first beam of radiation 110 where the target material 120 intercepts the first beam of radiation 110 correlates to the surface of the target material 120 that is intercepted by the first beam of radiation 110. Another factor that can impact the area of the first beam of radiation 110 where the target material 120 intercepts the first beam of radiation 110 is the stability of the location and size of the beam waist D1/2 of the first beam of radiation 110. For example, if the waist size and position of the first beam of radiation 110 is constant, then one can control the location of the target material 120 relative to the beam waist D1/2. It is possible that the waist size and position of the first beam of radiation 110 change due to, for example, thermal effects in the optical source 105. In general, it becomes important to maintain a constant energy of the pulses in the first beam of radiation 110 and also to control other aspects of the optical source 105 so that the target material 120 arrives at a known axial (Z direction) position with respect to the beam waist D1/2 without too much variation about that position.

All of the described methods to maintain or control the expansion rate of the modified target 121 to within an acceptable range of values employ the use of the measurement system 155, which is described next.

Figure 8A:
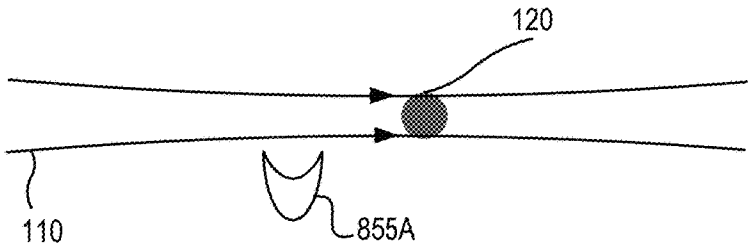
FIGS. 8A-8C and 9A-9C show schematic diagrams of various implementations of a measurement system that measures at least one characteristic associated with any one or more of a target material, a modified target, and the first beam of radiation.

Referring again to FIG. 1, the measurement system 155 measures at least one characteristic associated with any one or more of the target material 120, the modified target 121, and the first beam of radiation 110. For example, the measurement system 155 could measure an energy of the first beam of radiation 110. As shown in FIG. 8A, an exemplary measurement system 855A measures the energy of the first beam of radiation 110 that is directed to the target material 120.

Figure 8B:
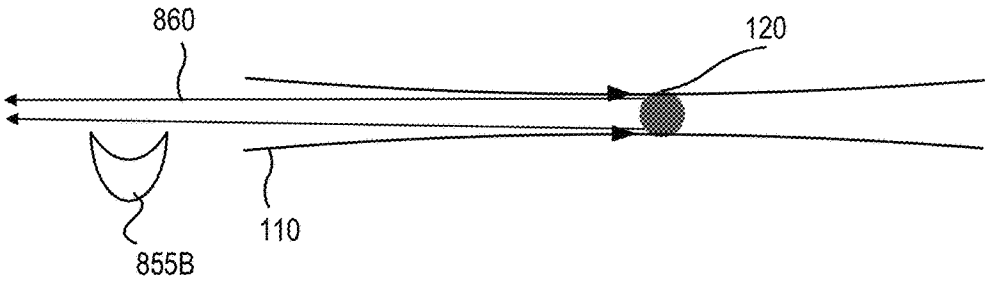

As shown in FIG. 8B, an exemplary measurement system 855B measures an energy of radiation 860 that is reflected from the target material 120 after the first beam of radiation 110 interacts with the target material 120. The reflection of the radiation 860 off the target material 120 can be used to determine the location of the target material 120 relative to the actual position of the first beam of radiation 110.

Figure 8C:
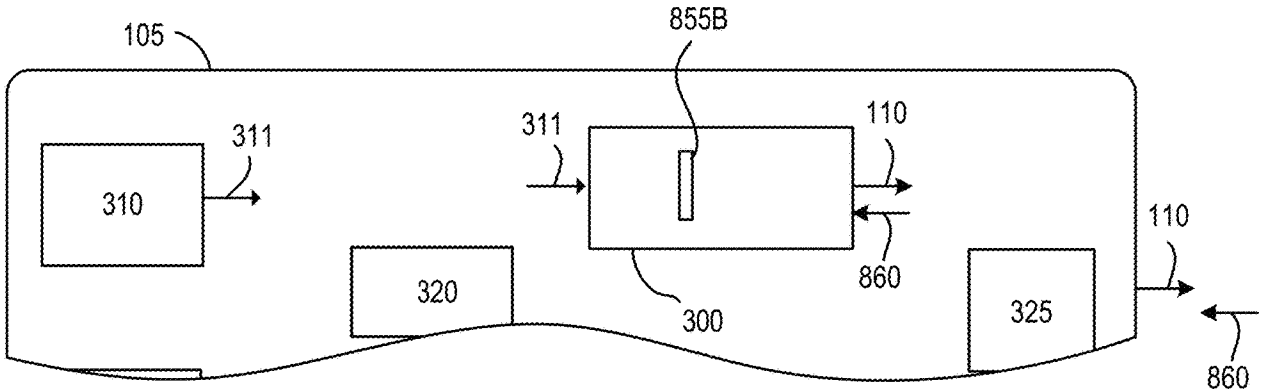

In some implementations, as shown in FIG. 8C, the exemplary measurement system 855B can be placed within the optical amplifier system 300 of the optical source 105. In this example, the measurement system 855B can be placed to measure an amount of energy in the reflected radiation 860 that impinges upon or reflects from one of the optical elements (such as a thin film polarizer) within the optical amplifier system 300. The amount of radiation 860 reflected from the target material 120 is proportional to an amount of energy delivered to the target material 120; thus, by measuring the reflected radiation 860, the amount of energy delivered to the target material 120 can be controlled or maintained. Additionally, the amount of energy that is measured in either the first beam of radiation 110 or the reflected radiation 860 correlates with a number of photons in the beam. Thus, it can be said that the measurement system 855A or 855B measures a number of photons in the respective beam. Additionally, the measurement system 855B can be considered to measure the number of photons that are reflected from the target material 120 (which is becomes a modified target 121 as soon as it is struck by the first beam of radiation 110) as a function of how many photons strike the target material 120.

The measurement system 855A or 855B can be a photoelectric sensor such as an array of photocells (for example, a 2×2 array or a 3×3 array). The photocells have a sensitivity for the wavelength of the light to be measured, and they have sufficient speed or bandwidth appropriate to the duration of the light pulses to be measured.

In general, the measurement system 855A or 855B can measure the energy of the beam of radiation 110 by measuring a spatially integrated energy across a direction that is perpendicular to a direction of propagation of the first beam of radiation 110. Because measurement of the energy of the beam can be performed rapidly, it is possible to take a measurement for each pulse emitted in the first beam of radiation 110, and therefore, the measurement and control can be on a pulse-to-pulse basis.

The measurement system 855A, 855B can be a fast photodetector, such as a photoelectromagnetic (PEM) detector that is appropriate for long-wavelength infrared (LWIR) radiation. The PEM detector can be a silicon diode for measuring near infrared or visible radiation or an InGaAs diode for measuring near infrared radiation. The energy of the pulses in the first beam of radiation 110 can be determined by integrating the laser pulse signals measured by the measurement system 855A, 855B.

Figure 9A:
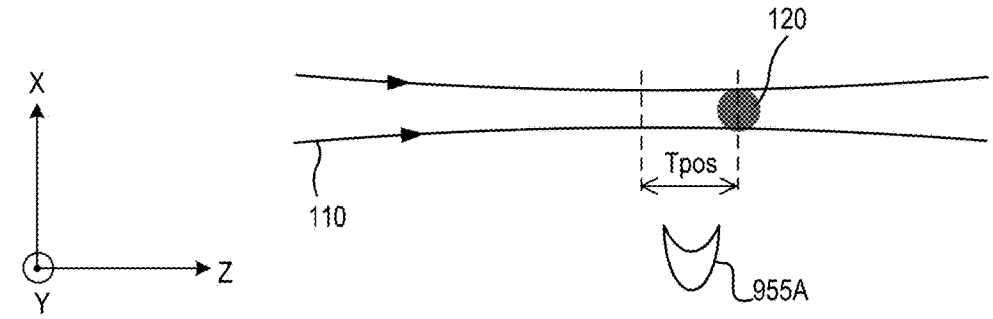

Referring to FIG. 9A, the measurement system 155 can be exemplary measurement system 955A, which measures a position Tpos of the target material 120 relative to a target position. The target position can be at the beam waist of the first beam of radiation 110. The position of the target material 120 can be measured along a direction that is parallel with a beam axis (such as the first axial direction 212) of the first beam of radiation 110.

Figure 9B:
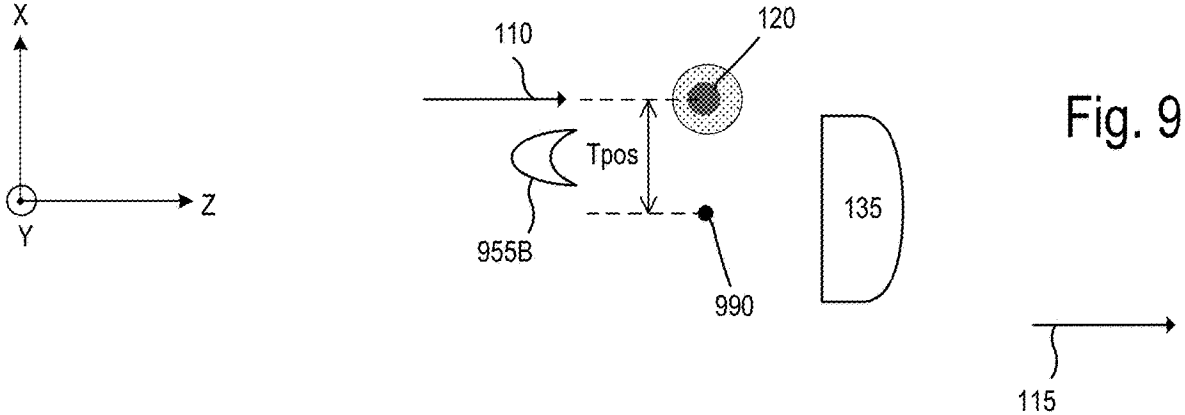

Referring to FIG. 9B, the measurement system 155 can be exemplary measurement system 955B, which measures a position Tpos of the target material 120 relative to a primary focus 990 of the light collector 135. Such a measurement system 955B can include lasers and/or cameras reflecting off the target material 120 as the target material 120 approaches to measure the position of the target material 120 and the arrival time of the target material 120 relative to a coordinate system within the chamber 165.

Figure 9C:
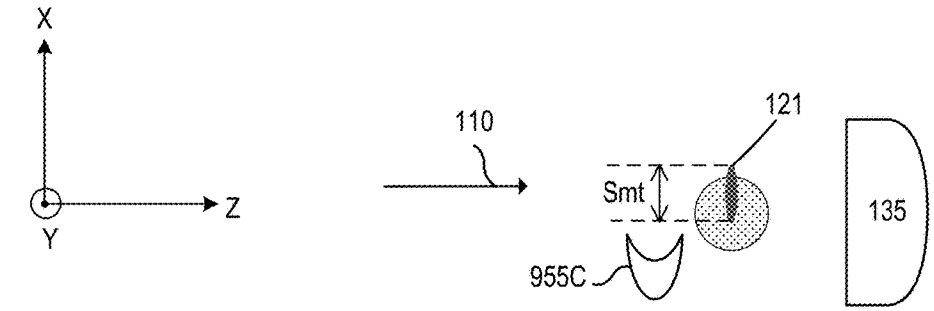

Referring to FIG. 9C, the measurement system 155 can be exemplary measurement system 955C, which measures a size of the modified target 121 at a position before the modified target 121 is interacted with the second beam of radiation 115. For example, the measurement system 955C can be configured to measure a size Smt of the modified target 121 while the modified target 121 is within the second target location 116 but before the modified target 121 is struck by the second beam of radiation 115. The measurement system 955C can also determine the orientation of the modified target 121. The measurement system 955C can use a shadowgraph technique of a pulsed backlighting illuminator and a camera (such as a charged-coupled device camera).

The measurement system 155 can include a set of measurement sub-systems, each sub-system designed to measure particular characteristics and at different speeds or sampling intervals. Such a set of sub-systems can work together to provide a clear picture of how the first beam of radiation 110 interacts with the target material 120 to form the modified target 121.

The measurement system 155 can include a plurality of EUV sensors within the chamber 165 for detecting the EUV energy emitted from the plasma produced by the modified target 121 after it interacts with the second beam of radiation 115. By detecting the EUV energy emitted it is possible to obtain information about the angle of the modified target 121 or the transverse offset of the second beam with respect to the second beam of radiation 115.

The beam adjustment system 180 is employed under control of the control system 160 to enable the control of the amount of energy delivered to the target material 120 (the radiant exposure). The radiant exposure can be controlled by controlling the amount of energy within the first beam of radiation 110 if it can be assumed that the area of the first beam of radiation 110 at the position at which it interacts with the target material 120 is constant. The beam adjustment system 180 receives one or more signals from the control system 160. The beam adjustment system 180 is configured to adjust one or more features of the optical source 105 to either maintain the amount of energy delivered to the target material 120 (that is, the radiant exposure) or to control the amount of energy directed to the target material 120. Thus, the beam adjustment system 180 can include one or more actuators that control features of the optical source 105, the actuators can be mechanical, electrical, optical, electromagnetic, or any suitable force device for causing the features of the optical source 105 to be modified.

In some implementations, the beam adjustment system 180 includes a pulse width adjustment system coupled to the first beam of radiation 110. The pulse width adjustment system is configured to adjust a pulse width of the first beam of radiation 110. In this implementation, the pulse width adjustment system can include an electro-optic modulator such as, for example, a Pockels cell. For example, the Pockels cell is arranged within the light generator 310 and by opening the Pockels cell for shorter or longer periods of time, the pulses that are transmitted by the Pockels cell (and thus the pulses that are emitted from the light generator 310) can be adjusted to be shorter or longer.

In other implementations, the beam adjustment system 180 includes a pulse power adjustment system coupled to the first beam of radiation 110. The pulse power adjustment system is configured to adjust a power of each pulse of the first beam of radiation 110, for example, by adjusting an average power within each pulse. In this implementation, the pulse power adjustment system can include an acousto-optic modulator. The acousto-optic modulator can be arranged so that a change in RF signal applied to a piezoelectric transducer at the edge of the modulator can be varied to thereby change the power of the pulse that is diffracted from the acousto-optic modulator.

In some implementations, the beam adjustment system 180 includes an energy adjustment system coupled to the first beam of radiation 110. The energy adjustment system is configured to adjust an energy of the first beam of radiation 110. For example, the energy adjustment system can be an electrically-variable attenuator (such as a Pockels cell varied between 0V and the half-wave voltage or an external acousto-optic modulator).

In some implementations, the position or angle of the target material 120 relative to the beam waist D1/2 varies so much that the beam adjustment system 180 includes an apparatus that controls the location or angle of the beam waist D1/2 relative to the first target location 111 or relative to another location within the chamber 165 in the coordinate system of the chamber 165. The apparatus can be a part of the focus assembly 156, and it can be used to move the beam waist along the Z direction or along a direction transverse to the Z direction (for example, along the plane defined by the X and Y directions).

Figure 10:
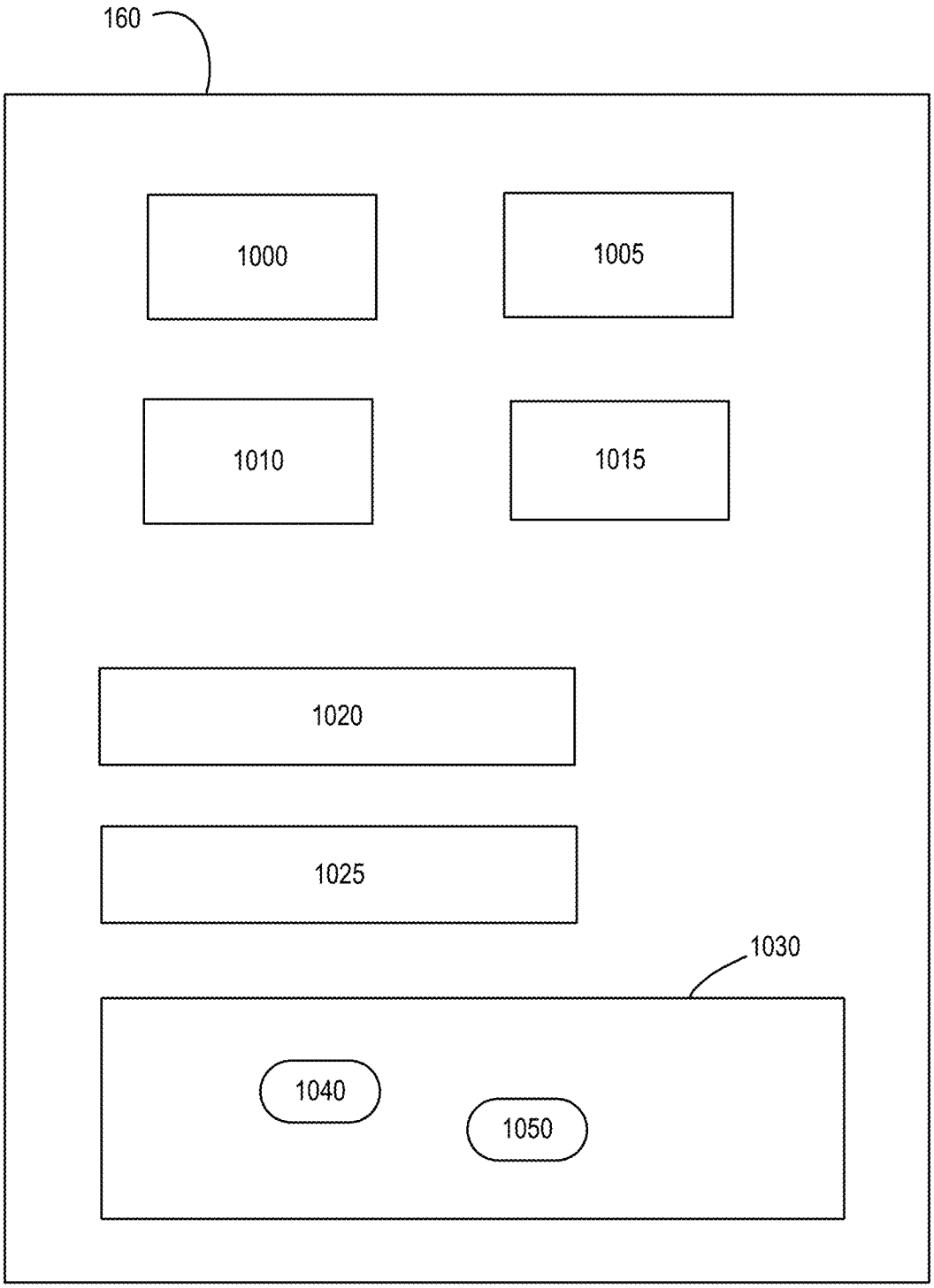
FIG. 10 is a block diagram of an exemplary control system of the light source of FIG. 1.

As discussed above, the control system 160 analyzes the information received from the measurement system 155, and determines how to adjust one or more properties of the first beam of radiation 110 to thereby control and maintain an expansion rate of the modified target 121. Referring to FIG. 10, the control system 160 can include one or more sub-controllers 1000, 1005, 1010, 1015 that interface with the other parts of the light source 100 such as a sub-controller 1000 specifically configured to interface with (receive information from and send information to) the optical source 105, a sub-controller 1005 specifically configured to interface with the measurement system 155, a sub-controller 1010 configured to interface with the beam delivery system 150, and a sub-controller 1015 configured to interface with the target material supply system 125. The light source 100 can include other components not shown in FIGS. 1 and 10 but that can interface with the control system 160. For example, the light source 100 can include diagnostic systems such as a droplet position detection feedback system and one or more target or droplet imagers. The target imagers provide an output indicative of the position of a droplet, for example, relative to a specific position (such as the primary focus 990 of the light collector 135) and provide this output to the droplet position detection feedback system, which can, for example, compute a droplet position and trajectory from which a droplet position error can be computed either on a droplet by droplet basis or on average. The droplet position detection feedback system thus provides the droplet position error as an input to a sub-controller of the control system 160. The control system 160 can provide a laser position, direction, and timing correction signal, for example, to the laser control system within the optical source 105 that can be used, for example, to control the laser timing circuit and/or to the beam control system to control an amplified light beam position and shaping of the beam transport system to change the location and/or focal power of the focal plane of the first beam of radiation 110 or the second beam of radiation 115.

The target material delivery system 125 includes a target material delivery control system that is operable in response to a signal from the control system 160, for example, to modify the release point of the droplets of target material 120 as released by an internal delivery mechanism to correct for errors in the droplets arriving at the desired target location 111.

The control system 160 generally includes one or more of digital electronic circuitry, computer hardware, firmware, and software. The control system 160 can also include appropriate input and output devices 1020, one or more programmable processors 1025, and one or more computer program products 1030 tangibly embodied in a machine-readable storage device for execution by a programmable processor. Moreover, each of the sub-controllers such as sub-controllers 1000, 1005, 1010, 1015 can include their own appropriate input and output devices, one or more programmable processors, and one or more computer program products tangibly embodied in a machine-readable storage device for execution by a programmable processor The one or more programmable processors can each execute a program of instructions to perform desired functions by operating on input data and generating appropriate output. Generally, the processor receives instructions and data from a read-only memory and/or a random access memory. Storage devices suitable for tangibly embodying computer program instructions and data include all forms of non-volatile memory, including, by way of example, semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, specially designed ASICs (application-specific integrated circuits).

To this end, the control system 160 includes an analysis program 1040 that receives measurement data from the one or more measurements systems 155. In general, the analysis program 1040 performs all of the analysis needed to determine how to modify or control an energy delivered to the target material 120 from the first beam of radiation 110 or to modify or control an energy of the first beam of radiation 110, and such analysis can be performed on a pulse-to-pulse basis if the measurement data is obtained on a pulse-to-pulse basis.

Figure 11:
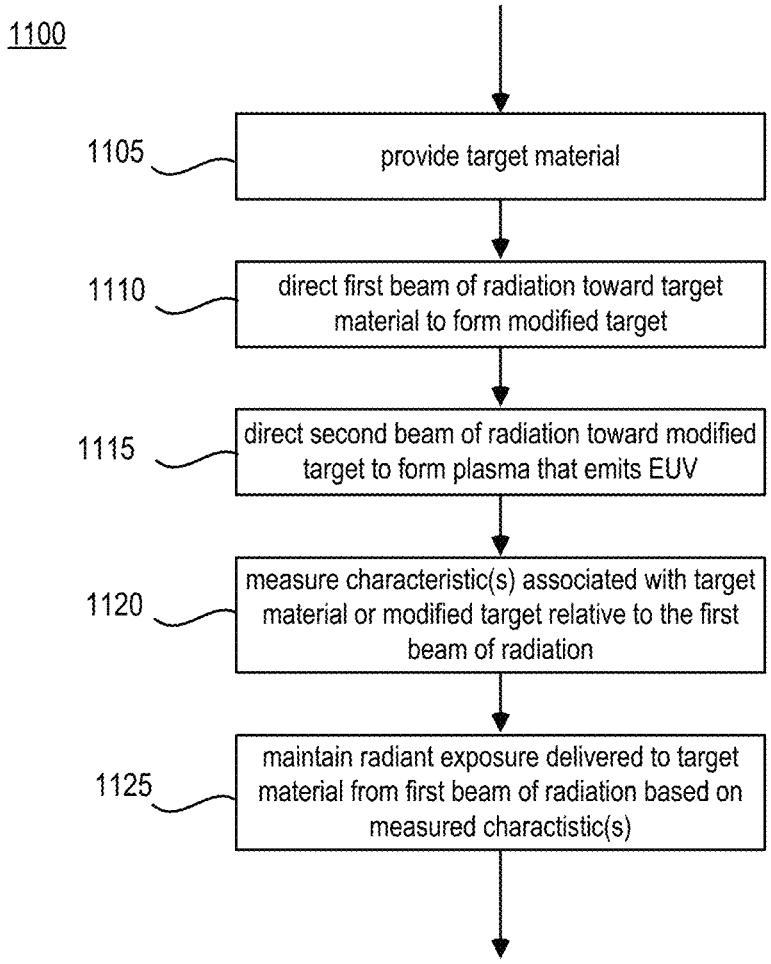
FIG. 11 is a flow chart of an exemplary procedure performed by the light source (under control of the control system) for maintaining or controlling an expansion rate (ER) of the modified target to thereby improve the conversion efficiency of the light source.

Referring to FIG. 11, the light source 100 (under control of the control system 160) performs a procedure 1100 for maintaining or controlling an expansion rate (ER) of the modified target 121 to thereby improve the conversion efficiency of the light source 100. The light source 100 provides the target material 120 (1105). For example, the target material supply system 125 (under control of the control system 160) can deliver the target material 120 to the first target location 111. The target material supply system 125 can include its own actuation system (connected to the control system 160) and a nozzle, through which the target material is forced, where the actuation system controls an amount of target material that is directed through the nozzle to produce a stream of droplets directed toward the first target location 111.

Next, the light source 100 directs the first beam of radiation 110 toward the target material 120 to deliver energy to the target material 120 to modify a geometric distribution of the target material 120 to form the modified target 121 (1110). In particular, the first beam of radiation 110 is directed through a first set 300 of one or more optical amplifiers toward the target material 120. For example, the optical source 105 can be activated by the control system 160 to generate the first beam of radiation 110 (in the form of pulses), which can be directed toward the target material 120 within the target location 111, as shown in FIG. 2. A focal plane (which is at the beam waist D1/2) of the first beam of radiation 110 can be configured to cross the target location 111. Moreover, in some implementations, the focal plane can overlap the target material 120 or an edge of the target material 120 that faces the first beam of radiation 110. The first beam of radiation 110 can be directed to the target material 120 (1110) by, for example, directing the first beam of radiation 110 through the beam delivery system 150, where various optics can be used to modify a direction or shape or divergence of the radiation 110 so that it can interact with the target material 120.

The first beam of radiation 110 can be directed toward the target material 120 (1110) by overlapping the target material 120 with an area of the first beam of radiation 110 that encompasses its confocal parameter. In some implementations, the confocal parameter of the first beam of radiation 110 can be so long that the beam waist (D1/2) easily encompasses the target material 120 and the area (that is measured across the X direction) of the surface of the target material 120 that is intercepted by the first beam of radiation 110 remains relatively constant even if the position of the target material 120 deviates from the location of the beam waist D1/2 (as shown in FIG. 7A). For example, the confocal parameter of the first beam of radiation 110 can be greater than 1.5 mm. In other implementations, the confocal parameter of the first beam of radiation 110 is so short that the beam waist (D1/2) does not encompass the target material 120 and the area of the surface of the target material 120 intercepted by the first beam of radiation 110 deviates quite a bit if the position of the target material 120 deviates from the location L1 of the beam waist D1/2 (as shown in FIG. 7B). For example, the confocal parameter can be, for example, less than or equal to 2 mm.

The modified target 121 changes its shape from the shape of the target material 120 just after impact by the first beam of radiation 110 into an expanded shape, and this expanded shape continues to deform as it drifts away from the first target location 111 toward the second target location 116. The modified target 121 can have a geometric distribution that deforms from the shape of the target material into a disk shaped volume of molten metal having a substantially planar surface (such as shown in FIGS. 1 and 2). The modified target 121 is transformed into the disk shaped volume in accordance with an expansion rate. The modified target 121 is transformed by expanding the modified target 121 along at least one axis according to the expansion rate. For example, as shown in FIG. 2, the modified target 121 is expanded at least along the long axis 230, which is generally parallel with the X direction. The modified target 121 is expanded along the at least one axis that is not parallel with the optical axis (which is the second axial direction 217) of the second beam of radiation 115.

Although the first beam of radiation 110 primarily interacts with the target material 120 by changing the shape of the target material 120, it is possible for the first beam of radiation 110 to interact with the target material 120 in other ways; for example, the first beam of radiation 110 could convert a part of the target material 120 to plasma that emits EUV light. However, less EUV light is emitted from the plasma created from the target material 120 than is emitted from the plasma created from the modified target 121 (due to the subsequent interaction between the modified target 121 and the second beam of radiation 115), and the predominant action on the target material 120 from the first beam of radiation 110 is the modification of the geometric distribution of the target material 120 to form the modified target 121.

The light source 100 directs the second beam of radiation 115 toward the modified target 121 so that the second beam of radiation converts at least part of the modified target 121 to plasma 129 that emits EUV light (1115). In particular, the light source 100 directs the second beam of radiation 115 through a second set 305 of one or more optical amplifiers toward the modified target 121. For example, the optical source 105 can be activated by the control system 160 to generate the second beam of radiation 115 (in the form of pulses), which can be directed toward the modified target 121 within the second target location 116, as shown in FIG. 2. At least one of the optical amplifiers in the first set 300 can be in the second set 305, such as the example shown in FIG. 5.

The light source 100 measures one or more characteristics (for example, the energy) associated with one or more of the target material 120 and the modified target 121 relative to the first beam of radiation 110 (1120). For example, the measurement system 155 measures the characteristics under control of the control system 160, and the control system 160 receives the measurement data from the measurement system 155. The light source 100 controls a radiant exposure at the target material 120 from the first beam of radiation 110 based on the one or more characteristics (1125). As discussed above, the radiant exposure is an amount of radiant energy delivered to the target material 120 from the first beam of radiation 110 per unit area. In other words, it is the radiant energy received by the surface of the target material 120 per unit area.

In some implementations, the characteristic that can be measured (1120) is an energy of the first beam of radiation 110. In other general implementations, the characteristic that can be measured (1120) is a position of the target material 120 relative to a position of the first beam of radiation 110 (for example, relative to a beam waist of the first beam of radiation 110), such position could be determined in either a longitudinal (Z) direction or a direction transverse (for example, in the X-Y plane) to the longitudinal direction.

The energy of the first beam of radiation 110 can be measured by measuring the energy of the radiation 860 reflected from an optically reflective surface of the target material 120 (such as shown in FIGS. 8B and 8C). The energy of the radiation 860 reflected from the optically reflective surface of the target material 120 can be measured by measuring a total intensity of the radiation 860 across four individual photocells.

The total energy content of the back reflected radiation 860 can be used in combination with other information about the first beam of radiation 110 to determine the relative position between the target material 120 and the beam waist of the first beam of radiation 110 along either the Z direction or a direction transverse to the Z direction (such as in the X-Y plane). Or, the total energy content of the back reflected radiation 860 can be used (along with other information) to determine a relative position between the target material 120 and the beam waist of the first beam of radiation along the Z direction.

The energy of the first beam of radiation 110 can be measured by measuring an energy of the first beam of radiation 110 directed toward the target material 120 (such as shown in FIG. 8A). The energy of the first beam of radiation 110 can be measured by measuring a spatially integrated energy across a direction perpendicular to a direction of propagation (the first axial direction 212) of the first beam of radiation 110.

In some implementations, the characteristic that can be measured (1120) is a pointing or direction of the first beam of radiation 110 as it travels toward the target material 120 (as shown in FIG. 8A). This information about the pointing can be used to determine an overlap error between a position of the target material 120 and an axis of the first beam of radiation 110.

In some implementations, the characteristic that can be measured (1120) is a position of the target material 120 relative to a target position. The target position can be at a beam waist (D1/2) of the first beam of radiation 110 along the Z direction. The position of the target material 120 can be measured along a direction that is parallel with the first axial direction 212. The target position can be measured relative to the primary focus 990 of the light collector 135. The position of the target material 120 can be measured along two or more non-parallel directions.

In some implementations, the characteristic that can be measured (1120) is a size of the modified target before the second beam of radiation converts at least part of the modified target to plasma.

In some implementations, the characteristic that can be measured (1120) corresponds to an estimate of an expansion rate of the modified target.

In some implementations, the characteristic that can be measured (1120) corresponds to a spatial characteristic of the radiation 860 that is reflected from the optically reflective surface of the target material 120 (such as shown in FIGS. 8B and 8C). Such information can be used to determine the relative position between the target material 120 and the beam waist of the first beam of radiation 110 (for example, along the Z direction). This spatial characteristic can be determined or measured by using an astigmatic imaging system placed in the path of the reflected radiation 860.

In some implementations, the characteristic that can be measured (1120) corresponds to an angle at which the radiation 860 is directed relative to the angle of the first beam of radiation 110. This measured angle can be used to determine a distance between the target material 120 and a beam axis of the first beam of radiation 110 along a direction transverse to the Z direction.

In other implementations, the characteristic that can be measured (1120) corresponds to a spatial aspect of the modified target 121 formed after the first beam of radiation 110 interacts with the target material 120. For example, the angle of the modified target 121 can be measured relative to a direction, for example, a direction in the X-Y plane that is transverse to the Z direction. Such information about the angle of the modified target 121 can be used to determine a distance between the target material 120 and the axis of the first beam of radiation 110 along a direction transverse to the Z direction. As another example, the size or expansion rate of the modified target 121 can be measured after a predetermined or set time after it is first formed from the interaction between the target material 120 and the first beam of radiation 110. Such information about the size or expansion rate of the modified target 121 can be used to determine a distance between the target material 120 and the beam waist of the first beam of radiation 110 along a longitudinal direction (Z direction), if one knows that the energy of the first beam of radiation 110 is constant.

The characteristic can be measured (1120) as fast as for each pulse of the first beam of radiation 110. For example, if the measurement system 155 includes PEMs or quadcells (arrangement of 4 PEMs), the measurement rate could be as fast as pulse to pulse.

On the other hand, for a measurement system 155 that is measuring characteristics such as the size or expansion rate of the target material 120 or the modified target 121, a camera can be used for the measurement system 155, but a camera is typically much slower, for example, a camera could measure at a rate of about 1 Hz to about 200 Hz.

In some implementations, the amount of radiant exposure delivered to the target material 120 from the first beam of radiation 110 can be controlled (1125) to thereby control or maintain an expansion rate of the modified target. In other implementations, the amount of radiant exposure delivered to the target material 120 from the first beam of radiation 110 can be controlled (1125) by determining whether a feature of the first beam of radiation 110 should be adjusted based on the one or more measured characteristics. Thus, if it is determined that the feature of the first beam of radiation 110 should be adjusted, then, for example, the energy content of a pulse of the first beam of radiation 110 can be adjusted or an area of the first beam of radiation 110 at the position of the target material 120 can be adjusted. The energy content of the pulse of the first beam of radiation 110 can be adjusted by adjusting one or more of a pulse width of the first beam of radiation 110, a pulse duration of the first beam of radiation 110, and an average or instantaneous power of a pulse of the first beam of radiation 110. The area of the first beam of radiation 110 that interacts with the target material 120 can be adjusted by adjusting a relative axial (along the Z direction) position between the target material 120 and the beam waist of the first beam of radiation 110.

In some implementations, the one or more characteristics can be measured (1120) for each pulse of the first beam of radiation 110. In this way, it can be determined whether the feature of the first beam of radiation 110 should be adjusted for each pulse of the first beam of radiation 110.

In some implementations, the radiant exposure delivered to the target material 120 from the first beam of radiation 110 can be controlled (for example, to within the acceptable range of radiant exposures) by controlling the radiant exposure while at least a portion of the emitted and collected EUV light 140 is exposing a wafer of a lithography tool.

The procedure 1100 can also include collecting at least a portion of the EUV light 130 emitted from the plasma (using the light collector 135); and directing the collected EUV light 140 toward a wafer to expose the wafer to the EUV light 140.

In some implementations, the one or more measured characteristics (1120) include a number of photons reflected from the modified target 121. The number of photons reflected from the modified target 121 can be measured as a function of how many photons strike the target material 120.

As discussed above, the procedure 1100 includes controlling the radiant exposure at the target material 120 from the first beam of radiation 110 (1125) based on the one or more characteristics. For example, the radiant exposure can be controlled 1125 so that it is maintained to within a predetermined range of radiant exposures. The radiant exposure is an amount of radiant energy delivered to the target material 120 from the first beam of radiation 110 per unit area. In other words, it is the radiant energy received by the surface of the target material 120 per unit area. If the unit area of surface of target material 120 exposed to or intercepted by the first beam of radiation 110 is controlled (or maintained to within an acceptable range) then this factor of the radiant exposure remains relatively constant and it is possible to control the radiant exposure or to maintain the radiant exposure at the target material 120 (1125) by maintaining the energy of the first beam of radiation 110 to within an acceptable range of energies. There are various ways to maintain the unit area of the surface of the target material 120 exposed to the first beam of radiation 110 to an acceptable range of areas. These are discussed next.

The radiant exposure at the target material 120 from the first beam of radiation 110 (1125) can be controlled so that an energy of a pulse of the first beam of radiation 110 is maintained (by a feedback control using the measured characteristics 1120) at a constant level or within a range of acceptable values despite disturbances that may cause the energy to fluctuate.

In other aspects, the radiant exposure at the target material 120 from the first beam of radiation 110 (1125) can be controlled so that an energy of a pulse of the first beam of radiation 110 is adjusted (for example, increased or decreased) by a feedback control using the measured characteristics 1120 to compensate for an error in a longitudinal (Z direction) placement of a position of the target material 120 relative to a beam waist of the first beam of radiation 110.

The first beam of radiation 110 can be a pulsed beam of radiation such that pulses of light are directed toward the target material 120 (1110). Similarly, the second beam of radiation 115 can be a pulsed beam of radiation such that pulses of light are directed toward the modified target 121 (1115).

The target material 120 can be a droplet of the target material 120 produced from the target material supply system 125. In this way, the geometric distribution of the target material 120 can be modified into the modified target 121, which is transformed into a disk shaped volume of molten metal having a substantially planar surface. The target material droplet is transformed into the disk shaped volume in accordance with an expansion rate.

Referring to FIG. 12, a procedure 1200 is performed by the light source 100 (under control of the control system 160) to stabilize the EUV light energy produced by the plasma 129 formed from the interaction between the modified target 121 with the second beam of radiation 115. Similar to the procedure 1100 above, the light source 100 provides the target material 120 (1205); the light source 100 directs the first beam of radiation 110 toward the target material 120 to deliver energy to the target material 120 to modify a geometric distribution of the target material 120 to form the modified target 121 (1210); and the light source 100 directs the second beam of radiation 115 toward the modified target 121 so that the second beam of radiation converts at least part of the modified target 121 to plasma 129 that emits EUV light (1215). The light source 100 controls the radiant exposure applied to the target material 120 from the first beam of radiation 110 using the procedure 1110 (1220).

The power or energy of the EUV light 130 is stabilized by controlling the radiant exposure (1225). The EUV energy (or power) produced by the plasma 129 is dependent on at least two functions, the first being the conversion efficiency CE and the second being the energy of the second beam of radiation 115. The conversion efficiency is the percentage of the modified target 121 that is converted to plasma 129 by the second beam of radiation 115. The conversion efficiency depends on several variables, including, the peak power of the second beam of radiation 115, the size of the modified target 121 when it interacts with the second beam of radiation 115, the position of the modified target 121 relative to a desired position, a transverse area or size of the second beam of radiation 115 as the moment it interacts with the modified target 121. Because the position of the modified target 121 and the size of the modified target 121 depend on how the target material 120 interacts with the first beam of radiation 110, by controlling the radiant exposure applied to the target material 120 from the first beam of radiation 110, one can control the expansion rate of the modified target 121, and thus, one can control these two factors. In this way, the conversion efficiency can be stabilizing or controlled by controlling the radiant exposure (1220), which therefore stabilizes the EUV energy produced by the plasma 129 (1225).

Referring also to FIG. 13, in some implementations, the first beam of radiation 110 can be produced by a dedicated sub-system 1305A within the optical source 105 and the second beam of radiation 115 can be produced by a dedicated and separate sub-system 1305B within the optical source 105 so that the beams of radiation 110, 115 follow two separate paths on the way to the respective first and second target locations 111, 116. In this way, each of the beams of radiation 110, 115 travel through respective subsystems of the beam delivery system 150, and thus, they travel through respective and separate optical steering components 1352A, 1352B and focus assemblies 1356A, 1356B.

For example, the sub-system 1305A can be a system that is based on solid-state gain media, while the sub-system 1305B can be a system that is based on gas gain media such as that produced by $CO_2$ amplifiers. Exemplary solid-state gain media that can be used as the sub-system 1305A include erbium doped fiber lasers and neodymium-doped yttrium aluminum garnet (Nd:YAG) lasers. In this example, the wavelength of the first beam of radiation 110 could be distinct from the wavelength of the second beam of radiation 115. For example, the wavelength of the first beam of radiation 110 that uses a solid-state gain medium can be about 1 μm (for example, about 1.06 μm), and the wavelength of the second beam of radiation 115 that uses a gas medium can be about 10.6 μm.

Other implementations are within the scope of the following claims.

What is claimed is:

1. An apparatus for an extreme ultraviolet (EUV) light source, the apparatus comprising:

an optical arrangement configured to interact a first beam of radiation with a target material within a chamber to form a modified target;

a first measurement system comprising a sensor configured to receive radiation reflected from the target material when the target material is interacted with the first beam of radiation;

a second measurement system comprising a plurality of measurement sub-systems, each sub-system configured to measure a spatial aspect of the modified target formed from the interaction between the first beam of radiation and the target material; and a control system in communication with the first measurement system and the second measurement system, the control system configured to analyze outputs from the first and second measurement systems, and to send information to the optical arrangement based on the analysis.

2. The apparatus of claim 1, wherein the control system being configured to send information to the optical arrangement based on the analysis causes the optical arrangement to adjust one or more properties of the first beam of radiation.

3. The apparatus of claim 1, wherein the control system being configured to send information to the optical arrangement based on the analysis comprises maintaining an energy of the first beam of radiation to within an acceptable range of energies.

4. The apparatus of claim 1, wherein the control system being configured to analyze the outputs from the first and second measurement systems comprises determining whether a feature of the first beam of radiation should be adjusted based on the analysis.

5. The apparatus of claim 1, wherein the optical arrangement being configured to interact the first beam of radiation with the target material to thereby form the modified target comprises modifying a geometric distribution of the target material.

6. The apparatus of claim 1, wherein each measurement sub-system is configured to measure the spatial aspect of the modified target by measuring one or more of a size, a position, and an orientation of the modified target.

7. The apparatus of claim 6, wherein each measurement sub-system includes a backlighting illuminator and a camera.

8. The apparatus of claim 7, wherein the camera is a charged-coupled device camera.

9. The apparatus of claim 6, wherein each measurement sub-system employs a shadowgraph technique.

10. The apparatus of claim 1, wherein the optical arrangement is further configured to interact a second beam of radiation with the modified target to convert at least part of the modified target to plasma that emits EUV light.

11. The apparatus of claim 1, wherein the optical arrangement comprises an optical source configured to produce the first beam of radiation and the second beam of radiation, and an optical steering system configured to steer the first beam of radiation toward an initial target location and to steer the second beam of radiation toward a target location.

12. The apparatus of claim 11, wherein the optical steering system comprises a focusing apparatus configured to focus the first beam of radiation at or near the initial target location and to focus the second beam of radiation at or near the target location.

13. A method comprising:

interacting a first beam of radiation with a target material within a chamber to form a modified target;

sensing radiation reflected from the target material when the target material is interacted with the first beam of radiation;

measuring a spatial aspect of the modified target with a first measurement sub-system and measuring a spatial aspect of the modified target with a second measurement sub-system;

analyzing the sensed radiation and outputs from the first and second measurement sub-systems; and controlling the first beam of radiation based on the analysis.

14. The method of claim 13, further comprising measuring an angle of the modified target relative to a direction based on the analysis of the outputs from the first and second measurement sub-systems.

15. The method of claim 13, further comprising measuring a size of the modified target based on the analysis of the outputs from the first and second measurement sub-systems.

16. The method of claim 13, wherein interacting the first beam of radiation with the target material to thereby form the modified target comprises modifying a geometric distribution of the target material to form the modified target.

17. The method of claim 16, wherein modifying the geometric distribution of the target material to form the modified target comprises forming a disk shaped volume that is expanded at least along a long axis.

18. The method of claim 13, further comprising interacting a second beam of radiation with the modified target, the second beam of radiation converting at least part of the modified target to plasma that emits EUV light.

19. The method of claim 13, wherein measuring the spatial aspect of the modified target comprises measuring one or more of a size, a position, and an orientation of the modified target.

20. The method of claim 13, wherein controlling the first beam of radiation based on the analysis comprises controlling one or more of an energy of the first beam of radiation and an amount of radiant exposure delivered to the target material from the first beam of radiation.

* * * * *